US009044076B2

(12) United States Patent
Temple

(10) Patent No.: US 9,044,076 B2
(45) Date of Patent: Jun. 2, 2015

(54) ROTATABLE HAIR IMPLEMENT

(71) Applicant: Sabrina Temple, Glen Allen, VA (US)

(72) Inventor: Sabrina Temple, Glen Allen, VA (US)

(73) Assignee: Sabrina Temple, Glen Allen, VA (US)

( * ) Notice: Subject to any disclaimer, the term of this patent is extended or adjusted under 35 U.S.C. 154(b) by 0 days.

(21) Appl. No.: 14/219,505

(22) Filed: Mar. 19, 2014

(65) Prior Publication Data

US 2014/0251358 A1 Sep. 11, 2014

Related U.S. Application Data

(63) Continuation-in-part of application No. 13/975,427, filed on Aug. 26, 2013.

(60) Provisional application No. 61/693,492, filed on Aug. 27, 2012.

(51) Int. Cl.

| | |
|---|---|
| ***A45D 24/00*** | (2006.01) |
| ***A45D 24/14*** | (2006.01) |
| ***A46B 5/02*** | (2006.01) |
| ***A45D 24/04*** | (2006.01) |
| ***A45D 24/18*** | (2006.01) |
| ***A45D 24/34*** | (2006.01) |
| ***A45D 24/38*** | (2006.01) |

(52) U.S. Cl.

CPC . *A45D 24/14* (2013.01); *A46B 5/02* (2013.01); *A45D 24/04* (2013.01); *A45D 24/18* (2013.01); *A45D 24/34* (2013.01); *A45D 24/38* (2013.01); *A45D 2024/002* (2013.01); *A46B 5/021* (2013.01); *A46B 2200/104* (2013.01)

(58) Field of Classification Search

CPC ..... A45D 24/10; A45D 24/14; A45D 24/16; A45D 24/04; A45D 24/34; A45D 24/38; A45D 24/18; A45D 2024/002; A46B 5/02; A46B 5/021; A46B 5/023; A46B 5/025; A46B 5/026; A46B 5/028; A46B 2200/104

USPC ..... 132/149, 200, 212, 213, 213.1, 219, 132/106, 107, 120, 121, 126, 129, 132, 132/134–136, 145, 148, 150, 103; 63/1.11, 63/3, 15, 15.5, 15.6, 15.7, 33, 41, 3.1; 119/600, 611, 612, 613, 614, 615, 616, 119/625; 29/8, 896.412; D28/21, 23, 25, D28/29, 30, 31; 16/430, 444, 445, 446, 2.4, 16/109; 81/177.3, 487; 384/95, 152, 569; 30/29, 195, 131, 252, 232, 341; 33/514.1, 555.2; 15/143.1

See application file for complete search history.

(56) References Cited

U.S. PATENT DOCUMENTS

| | | | | |
|---|---|---|---|---|
| 606,472 | A * | 6/1898 | Ogden | 30/341 |
| 2,150,260 | A | 3/1939 | Berry | |

(Continued)

OTHER PUBLICATIONS

USPTO Office Action for U.S. Appl. No. 13/975,427; dated May 6, 2014.

*Primary Examiner* — Vanitha Elgart
(74) *Attorney, Agent, or Firm* — McGuire Woods LLP

(57) ABSTRACT

A hair implement, such as a comb, brush, or pick, is disclosed that includes a handle section containing a ring insert within an annular opening in the handle section. When the hair implement is not in use, it may be held on a user's finger and rotate out of the way without the need for the user to disengage his or her finger from the hair implement, such as when using other hair implements.

15 Claims, 23 Drawing Sheets

(56) References Cited

U.S. PATENT DOCUMENTS

| | | | | | |
|---|---|---|---|---|---|
| 2,154,336 | A | * | 4/1939 | King | 132/139 |
| D118,810 | S | * | 2/1940 | Berry | D28/29 |
| 2,199,282 | A | * | 4/1940 | Condron et al. | 132/149 |
| 2,292,357 | A | | 8/1942 | Berry | |
| 2,489,168 | A | * | 11/1949 | Tuck | 30/233.5 |
| 2,568,898 | A | * | 9/1951 | Phillips et al. | 132/150 |
| 2,608,975 | A | * | 9/1952 | Shannon | 132/149 |
| 3,022,648 | A | * | 2/1962 | Thaler | 63/15 |
| 3,974,563 | A | * | 8/1976 | Koch | 30/341 |
| 4,336,972 | A | | 6/1982 | Dagiel | |
| 5,259,114 | A | * | 11/1993 | Shorter | 30/131 |
| 5,417,085 | A | * | 5/1995 | Regev | 63/15.2 |
| 5,778,540 | A | * | 7/1998 | Huang | 30/232 |
| 5,781,999 | A | * | 7/1998 | Chang | 30/260 |
| 5,987,757 | A | * | 11/1999 | Schmidt et al. | 30/341 |
| 6,672,105 | B1 | * | 1/2004 | Sills | 63/15.6 |
| 6,883,238 | B1 | * | 4/2005 | Tran | 30/232 |
| D508,757 | S | * | 8/2005 | Eddinger et al. | D28/34 |
| 7,373,728 | B2 | * | 5/2008 | Ferman et al. | 33/514.1 |
| 7,409,836 | B2 | * | 8/2008 | Czajka et al. | 63/15.6 |
| 7,797,782 | B2 | | 9/2010 | Davis et al. | |
| 2010/0242289 | A1 | * | 9/2010 | Roskam et al. | 30/232 |
| 2011/0289966 | A1 | * | 12/2011 | Ahrenholtz et al. | 63/15.6 |

* cited by examiner

ROTATABLE HAIR IMPLEMENT

CROSS-REFERENCED TO RELATED APPLICATIONS

This application is a continuation-in-part of U.S. application Ser. No. 13/975,427, filed Aug. 26, 2013, which claims the benefit of U.S. Provisional Application No. 61/693,402, filed Aug. 27, 2012, the contents each of which are incorporated herein by reference.

FIELD OF THE INVENTION

The field of the invention generally relates to hairdressing implements, more specifically to hair combs.

BACKGROUND OF THE INVENTION

The design and style of hair changes over time and amongst cultures. Irrespective of current hair trends, many people style hair using various implements in order to achieve a certain result. Typically, hairstyles are accomplished through the use of more than one device. Sometimes styling is achieved in a home environment or a professional setting such as a salon or barber shop. In a home environment, individuals may style hair with a creative flair that requires multiple devices to style hair and may require repeatedly picking up and laying down the devices to continue to style hair. Also, an individual might have a sense of urgency to quickly style hair for an event and may be rushing against the clock to leave for an event. When these types of circumstances happen, an individual might become inattentive to details. As a result, multiple devices used to style hair may become misplaced.

Similar to the home environment, a professional salon or barber shop often has a limited amount of space for the professional stylist to hold and organize various implements. When a professional is working with a client, it is often necessary for the professional stylist to hold a portion of the client's hair in one hand while simultaneously using an implement to accomplish the intended hairstyle in the other hand. This leaves the professional stylist with only one hand to use a styling implement or to switch between multiple styling implements. Combining the limited work space with the need for multiple styling tools can lead to a cluttered work environment along with misplacement of the desired hair equipment. When the total number of implements used to accomplish a hair styling task decreases, so follows a decreased likelihood for a cluttered workspace and misplacement of hair implements.

In a professional business setting, time correlates with income. The more clients a hair stylist can service, the greater the income. Some people lack the dexterity to use one hand to aptly manipulate an implement with multiple functions, or multiple implements with singular functions. Thus there remains a considerable need for methods and apparatuses that can conveniently allow a user to manipulate an implement to switch between multiple tasks quickly and efficiently without needing to remove the device from a user's control.

There is a need for a hair styling apparatus that enables a user to perform multiple functions without the need to completely release the hair styling device. There is a need for a hair implement that may be used to style hair (such as, but not limited to, parting, combing, brushing, and styling) without the need for additional separate tools or implements that may become misplaced. When one or more additional tools may be necessary, there remains a need for a hair styling apparatus that enables a user to easily and quickly pick up and use additional tools without completely releasing the hair styling device.

There is a need for hair implements that can be used to comb, brush, or style hair on a section of the hair implement, while also enabling the user to switch and perform a different hair styling task with another section of the implement, without ever requiring the user to set down the hair styling implement. There is a need for hair styling methods and apparatuses that facilitate the quick and efficient creation of hairstyles without requiring a user to switch between multiple separate devices and use additional separate tools to perform styling techniques.

SUMMARY OF THE INVENTION

An embodiment of the present invention is directed to hair styling methods and apparatuses that operatively connect a spine section having a plurality of teeth, with a handle section containing a rotational bearing. Among the many different possibilities contemplated, the hair styling implement may comprise a brush, comb, or pick. Moreover, the hair styling apparatus may comprise a finger support for a user to manipulate the apparatus, and a stem extending from the handle section. The finger support may be designed to ergonomically accommodate at least one user. The stem may be designed or configured for safety or efficiency to achieve a hair style result. It is further contemplated that the handle section's rotational bearing may be designed or configured to removably engage a ring insert. Such a ring insert may accommodate a user's finger of various sizes and the ring insert may be removably secured to the rotational bearing.

Another embodiment of the present invention is directed to methods of using a hair apparatus or implement. The method includes providing a hair apparatus (that may include embodiments previously described), holding the hair apparatus by the handle section, positioning the hair apparatus about the rotational bearing where the user may insert a digit (e.g., a finger) through the opening in the rotational bearing or ring insert, combing an object (such as, but not limited to, hair or fiber) with the plurality of teeth by applying pressure to a finger support, and rotating the hair implement about the rotational bearing while the user maintains contact with the handle section. This allows the user to maintain control over the implement without having to put down the implement and pick up another device to complete a desired task. Additionally, a user may hold the hair implement by the rotational bearing by inserting a finger or digit into the ring insert's aperture.

A further embodiment of the present invention may include implementations described above and also may be directed to various brush types such as, but not limited to, paddle brushes, round thermal brushes, wire brushes, oval brushes, cushioned brushes, sculpting brushes, or vented brushes. Similarly, an embodiment of the present invention may include implementations described above and may be directed to various comb types including, but not limited to, wide-tooth combs, rat tail combs, fine-tooth combs, pick combs, styling combs, or teasing combs. It is to be understood that embodiments of "hair" may include, but are not limited to, organic hair, inorganic hair, synthetic hair, fibers (such as, but not limited to, natural or synthetic), or filaments.

Further implementations do not require a separate rotational bearing, but permit the ring insert to rotate directly against the interior surface of the annular opening in the hair implement handle. Various features of this implementation are described below.

Various objects, features, aspects, and advantages of the present invention will become more apparent from the following detailed description of the invention, along with the accompanying drawings in which like numerals represent like components.

DETAILED DESCRIPTION

Figure 1:
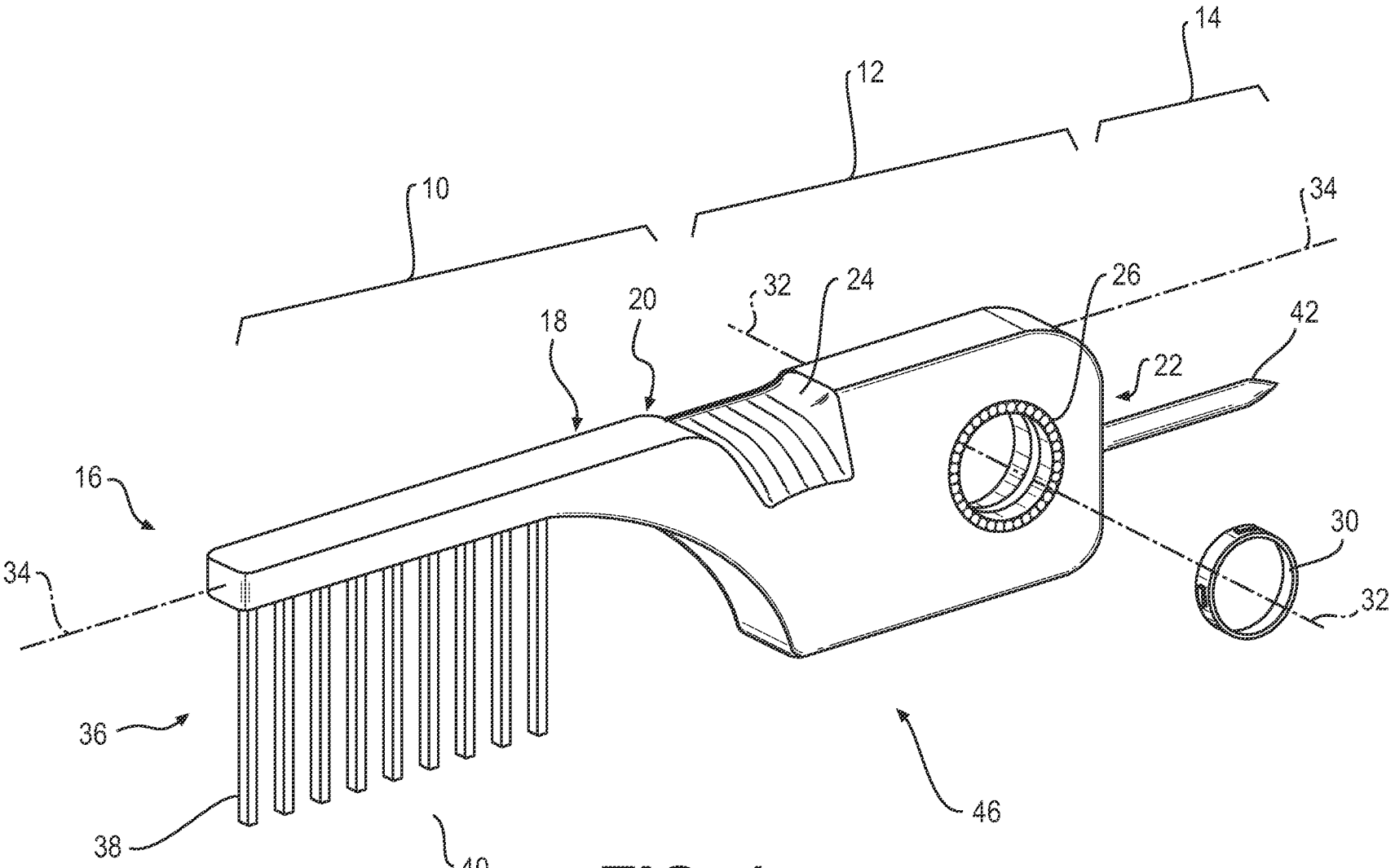
FIG. 1 is a perspective view of a hair implement according to the present invention.

The following description is merely exemplary in nature and is not intended to limit the present disclosure, application, or uses. It should be understood that throughout the drawings, corresponding reference numerals indicate like or corresponding parts and features.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

A number of materials are identified as suitable for various aspects of the hair implement. These materials are to be treated as exemplary and are not intended to limit the scope of the claims. Although any methods and materials similar or equivalent to those described herein can also be used in the practice or testing of the present invention, a limited number of the exemplary methods and materials are described herein.

It will be understood by those having ordinary skill in the art that the various shapes, openings, and cavities as described herein may be made through any applicable manufacturing technique or combinations of techniques, such as, but not limited to, casting, forging, drawing, turning, welding, cutting, drilling, injecting, reaming, or other techniques, regardless of the terminology used in describing those shapes, openings, apertures, or cavities.

It must be noted that, as used herein and in the appended claims, the singular forms "a", "an", and "the" include plural referents unless the context clearly dictates otherwise.

As used herein, the terms "tooth" or "teeth" or "spines" refer to long, relatively straight shafts that are typically attached to the end of a comb. Such shafts may be soft or rigid, straight or tapered, narrowly or widely spaced apart. The term is meant to encompass not only the teeth of a hard comb, but also the bristles of a brush that may be soft or rigid. In general, the term refers to the shafts or bristles of a comb or hair brush that are meant for use in detangling, styling, straightening, gathering or arranging hair as desired by the user.

As used herein, the term "rotational bearing" refers to a device that permits rotational motion of the parts around a fixed axis. The rotational bearing may include various types of bearings, such as ball bearings, roller bearings, magnetic bearings, or the like. The parts of the rotational bearing may be made of various suitable materials, including, but not limited to, plastic and metal. It may be desirable to use different materials depending on the intended use, for example, home versus commercial.

As used herein, a portion or part of a device may be described as "removable", "removably engaged", or the like. These terms are meant to designate that the portion or part may be removed from the device by a user without resort to use of additional tools or equipment, but would generally be removable by hand.

Hair Implement

The figures illustrate a method and apparatus of a hair implement of the present invention. As shown in FIG. 1, the hair implement 46 generally includes a spine section 10, a plurality of teeth 40, a handle section 12, a rotational bearing 26, a finger support 24, a stem section 14, and a ring insert 30. The stem section 14 may incorporate a stem 42.

The hair implement 46 allows a user to easily hold and manipulate a second implement to style hair without having to set down the hair implement 46. In this fashion, a user need not put down the hair implement 46 in order to pick up a second implement, such as hot curlers or the like. The ultimate design relies on ease of handling by the user, thereby reducing the cumbersome nature of switching between various styling implements by having to put one down prior to retrieving a second or subsequent implement when conducting the styling.

Additionally, the hair implement 46 allows a user to style hair with one section of the implement, then rotate the implement about the rotational bearing 26 to use another part of the implement (e.g., the stem 42) without compromising control or efficiency. The user need not reach for multiple separate styling devices. The hair implement 46 permits the user to perform multiple hair preparation techniques by inserting a finger into a ring insert 30 or rotational bearing 26 and rotating the hair implement 46, thus allowing for multiple functions and permitting the user to pick up additional hair implements, such as hot curlers, scissors, or other devices, without the need to set down hair implement 46.

Spine Section

In an embodiment shown in FIG. 1, a hair implement 46 comprises a spine section 10 having a plurality of teeth 40 (e.g., a row of teeth). The spine section 10 may be operatively connected to a handle section 12. It is to be understood that the spine section 10, the plurality of teeth 40, and the handle section 12 may be made from a single piece of material or may be comprised of two or more pieces of material that are fastened, adhered, or otherwise connected together.

Continuing to refer to FIG. 1, the spine section 10 may have a spine section proximal end 18 and a spine section distal end 16. The spine section 10 may also have at least one row of teeth 36. The at least one row of teeth 36 may be comprised of a number of individual teeth 38. Each tooth 38 may be made from one piece of material or multiple pieces. Each tooth 38 may be integrally formed with the spine section 10, or be attached or connected to the spine section 10. The spine section 10 may be operatively connected to the handle section 12 and may include the handle and spine being made from one piece or multiple pieces.

The plurality of teeth 40 may extend beneath the spine section 10 at least a distance that is longer than the length of finger support 24, at least approximately ¾ of an inch in length. The teeth may have a tapered shape down from spine section 10. The spine section 10 may have a plurality of teeth 40 located within a distance of approximately 4 inches from the spine section distal end 16. Further embodiments of the present invention may include the spine section 10 being approximately 4 inches in length.

The spine section 10 may have a spine central axis 34 that extends through the spine section proximal end 18, the spine section distal end 16, and the handle section distal end 20.

Figure 13:
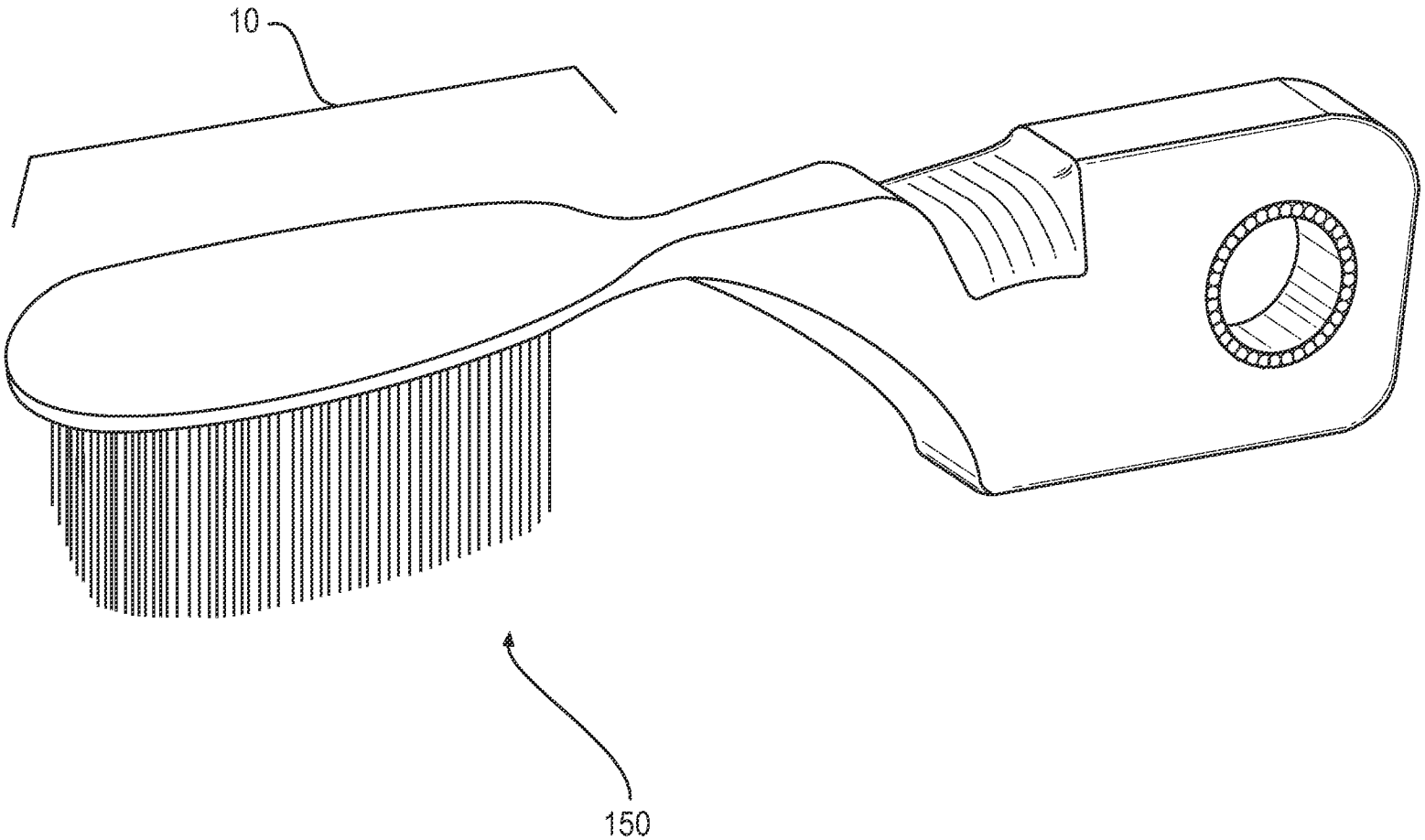
FIG. 13 is a perspective view of a flat brush embodiment of the present invention.

Various embodiments of the spine section 10 may allow for various different functions of the hair implement 46. Referring to FIGS. 10-13, several different embodiments of the spine section 10 are depicted and disclosed. It will be understood by one having ordinary skill in the art that various other hair tools may be applied to the present invention beyond those described and depicted with reference to FIGS. 1, 5, and 10-13. As such, the embodiments depicted with reference to FIGS. 1, 5, and 10-13 are not exhaustive. For example, the spine section 10 may include a hair pick tool 120 (FIG. 10), a round brush 130 (FIG. 11), a hair lift tool 140 (FIG. 12), or a flat brush 150 (FIG. 13).

The spine section 10 may be made of any suitable material, including, but not limited to, hard, sturdy plastic. The spine section 10 may come in various colors, including, but not limited to, red, blue, gray, and black.

Handle Section

Figure 7:
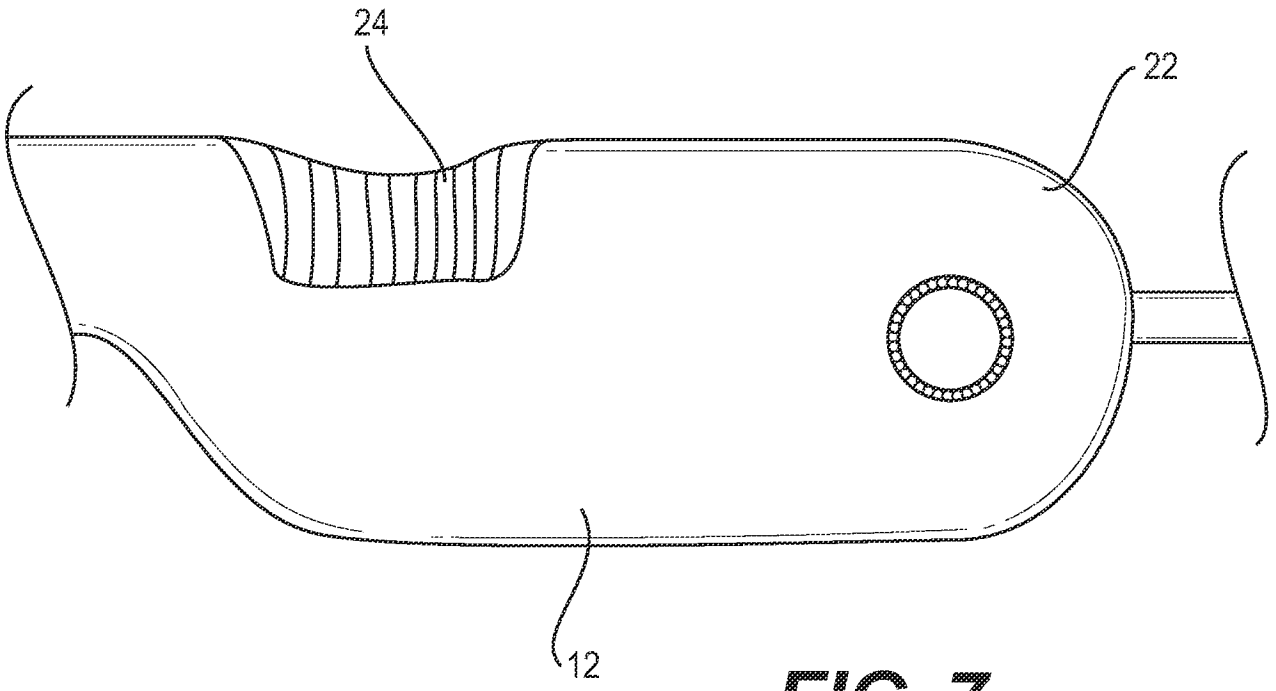
FIG. 7 is a portion of a front view showing a handle section as shown in FIG. 1.

Referring to FIGS. 1 and 7, the hair implement 46 may have a handle section 12 disposed proximate to a spine section 10. The handle section 12 may comprise a handle section distal end 20 and a handle section proximal end 22. An embodiment of the present invention may have a handle section 12 proximate to or integrally formed with a stem section 14 with the stem 42 extending from the handle section proximal end 22 in a direction generally away from the handle section proximal end 22 and/or the spine section proximal end 18. The handle section proximal end 22 may be disposed in a direction away from the spine section proximal end 18.

Figure 5:
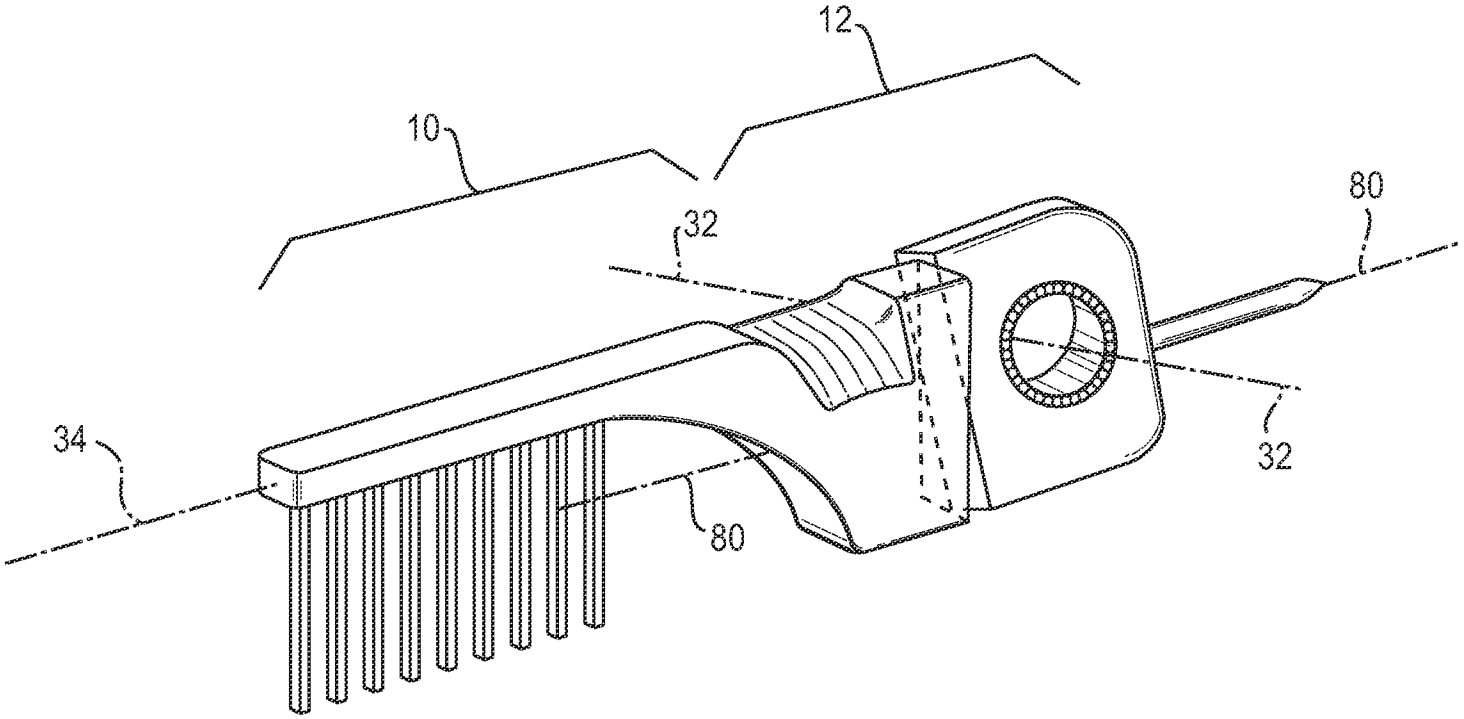
FIG. 5 is a perspective view of a portion of a hair implement with a portion of the handle section being rotatable about an axis parallel to a spine central axis.

Referring to FIG. 5, the spine section 10 may be operatively connected to the handle section 12 such that a portion of the handle section 12 is capable of rotating around an axis 80 parallel to the spine central axis 34. In some embodiments, the spine section 10 is capable of rotating around an axis 80 parallel to the spine central axis 34.

In certain embodiments of the present invention, the handle section 12 may contain a rotational bearing 26 having a bearing central axis 32, wherein the bearing central axis 32 may be perpendicular to a line extending from the spine section distal end 16 through the spine section proximal end 18.

In certain embodiments not shown, the handle section 12 may be designed in a different shape, such as in width (e.g., where the width of the handle section may adapt to the shape and configuration of the spine section).

The handle section 12 may be made of any suitable material, including, but not limited to, hard, sturdy plastic. The handle section 12 may come in various colors, including, but not limited to, red, blue, gray, and black.

Rotational Bearing

Figure 8A:
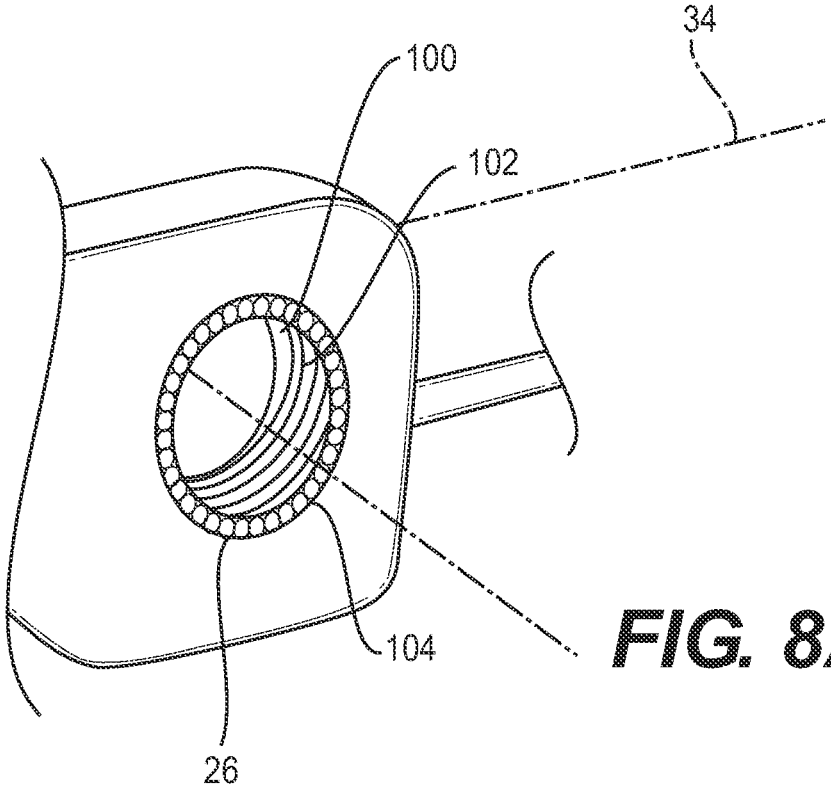
FIG. 8A is a portion of a perspective view of a handle section with a rotational bearing as shown in FIG. 1.
Figure 8B:
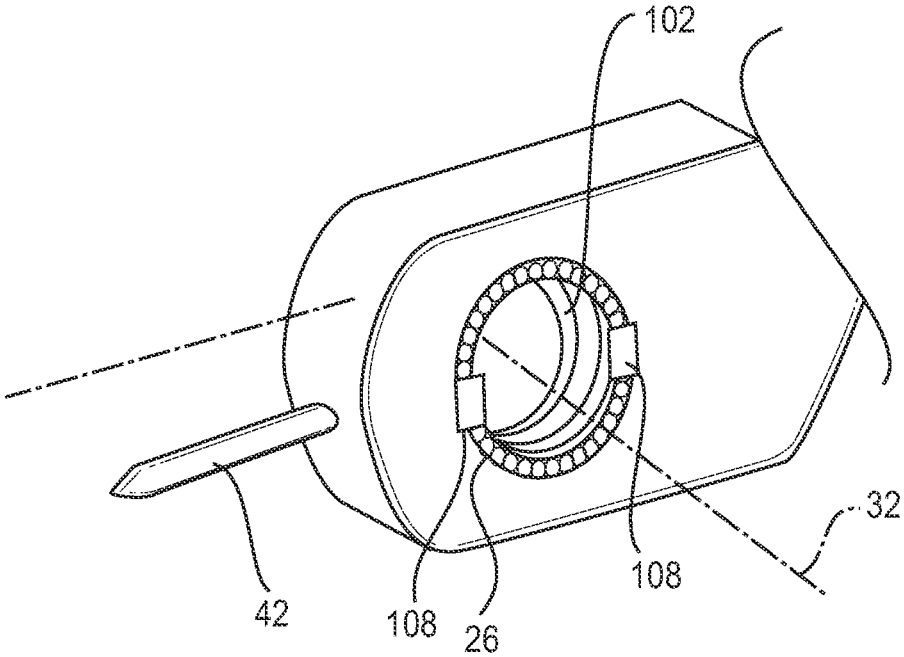
FIG. 8B is a portion of an alternative perspective view of a handle section with a rotational bearing having a bearing securing feature as shown in FIG. 1;.
Figure 8C:
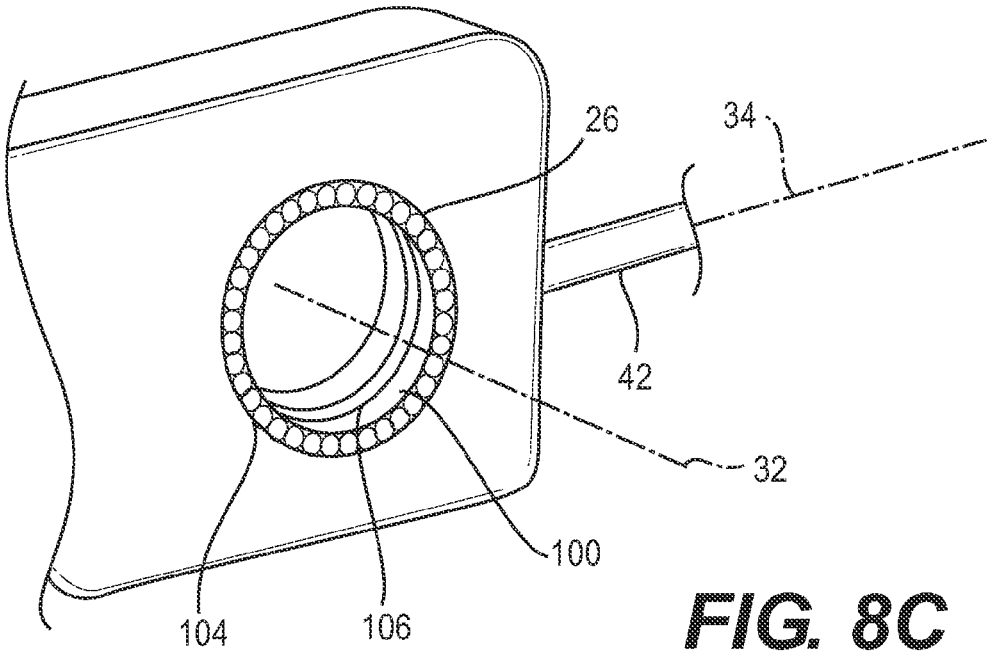
FIG. 8C is a portion of an alternative perspective view of a handle section as shown in FIG. 1 with a rotational bearing having a groove within the inner race of the present invention.

Referring to FIGS. 1, 8A, and 8C, the handle section 12 may contain a rotational bearing 26 having a bearing central axis 32. The bearing central axis 32 may be perpendicular to the spine central axis 34.

The rotational bearing 26 is described herein with reference to an inner race 100 and an outer race 104. It is to be understood that the term "race" refers to an element on which the rolling element of the bearing rides. The "inner race" 100 refers to the smaller interior rotational element, while the "outer race" 104 refers to the exterior rotational element. As noted below, these races are generally meant to rotate independently of each other.

The rotational bearing 26 may have a "threaded" portion. This term as used herein is meant to designate the way in which a part is designed to be connected to another part. For example, a thread will typically be either a male thread, referring to a cylindrical bar rod or shank having a helical ridge that would correspond to a female thread, referring to a cylindrical hole having a corresponding helical groove therein. An example of such a thread would be a nut and bolt or screw that can be used as an attachment.

Embodiments of the present invention may have a rotational bearing 26 made from materials similar to or different from that of the handle section 12 or spine section 10. The rotational bearing 26 may be fastened, adhered, pressed or otherwise connected to the handle section 12. Various types and designs of rotational bearings may be used for the rotational bearing 26 so long as an inner race 100 is capable of rotating independently from an outer race 104.

Figure 9:
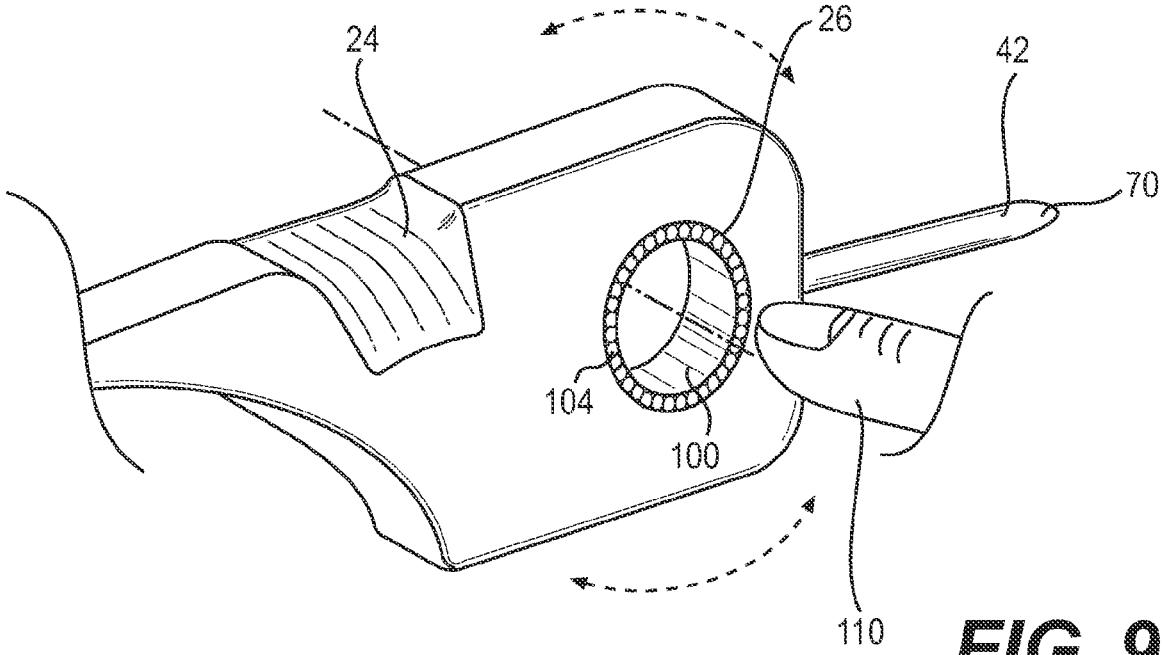
FIG. 9 is a portion of a perspective view of use of a hair implement as shown in FIG. 1.
Figure 10:
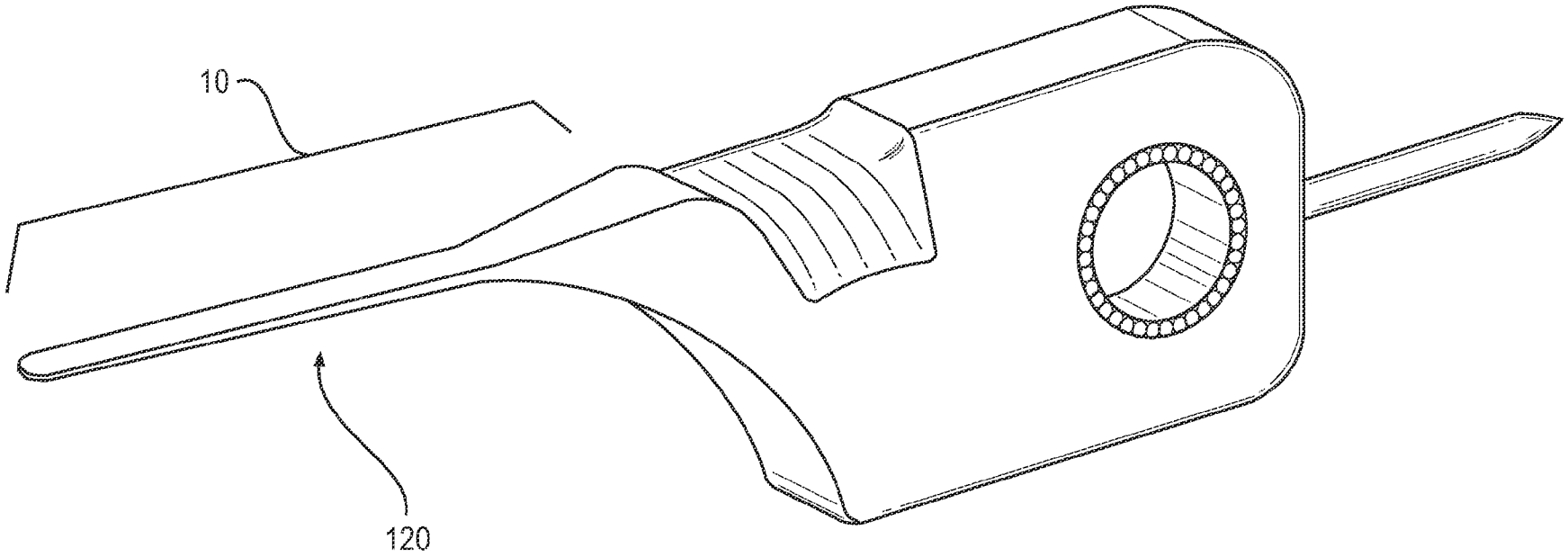
FIG. 10 is a perspective view of a hair pick embodiment of the present invention.
Figure 11:
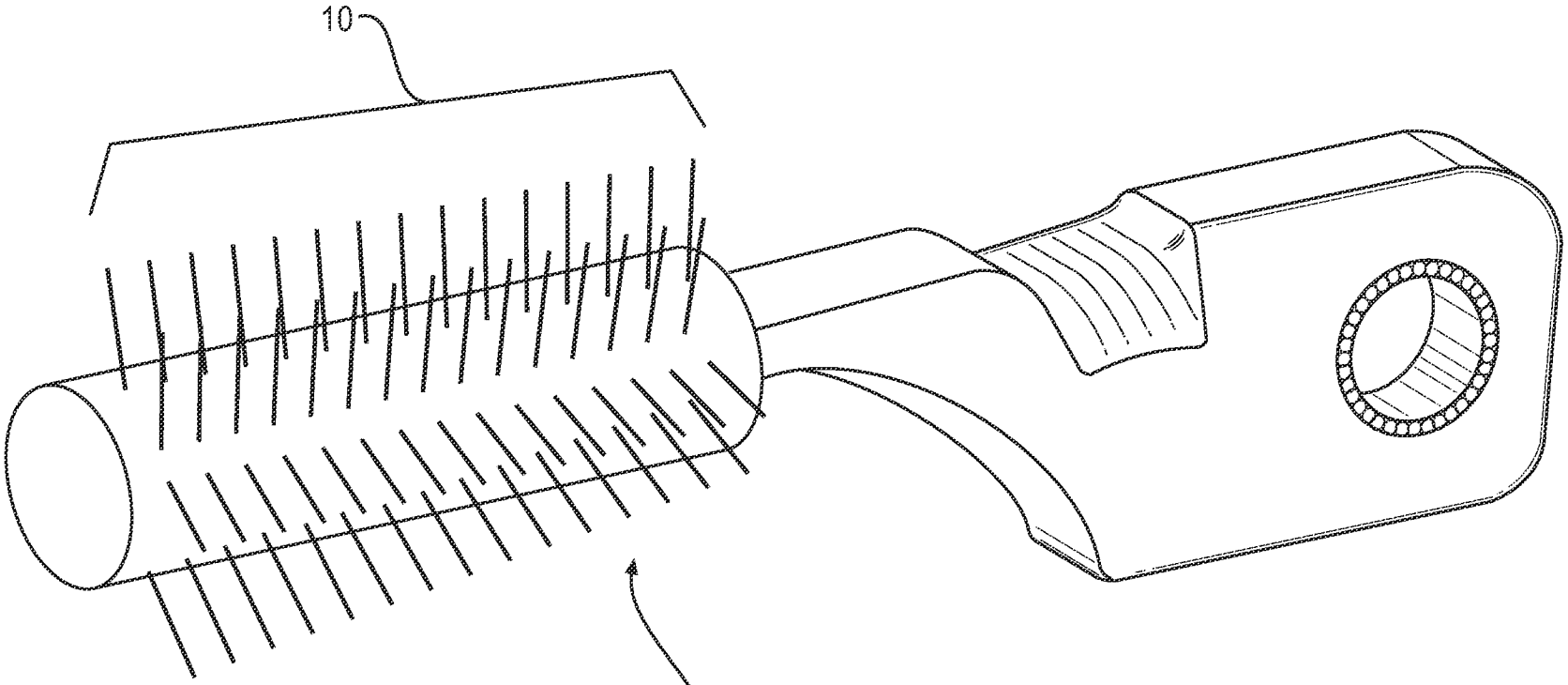
FIG. 11 is a perspective view of a round brush embodiment of the present invention.
Figure 12:
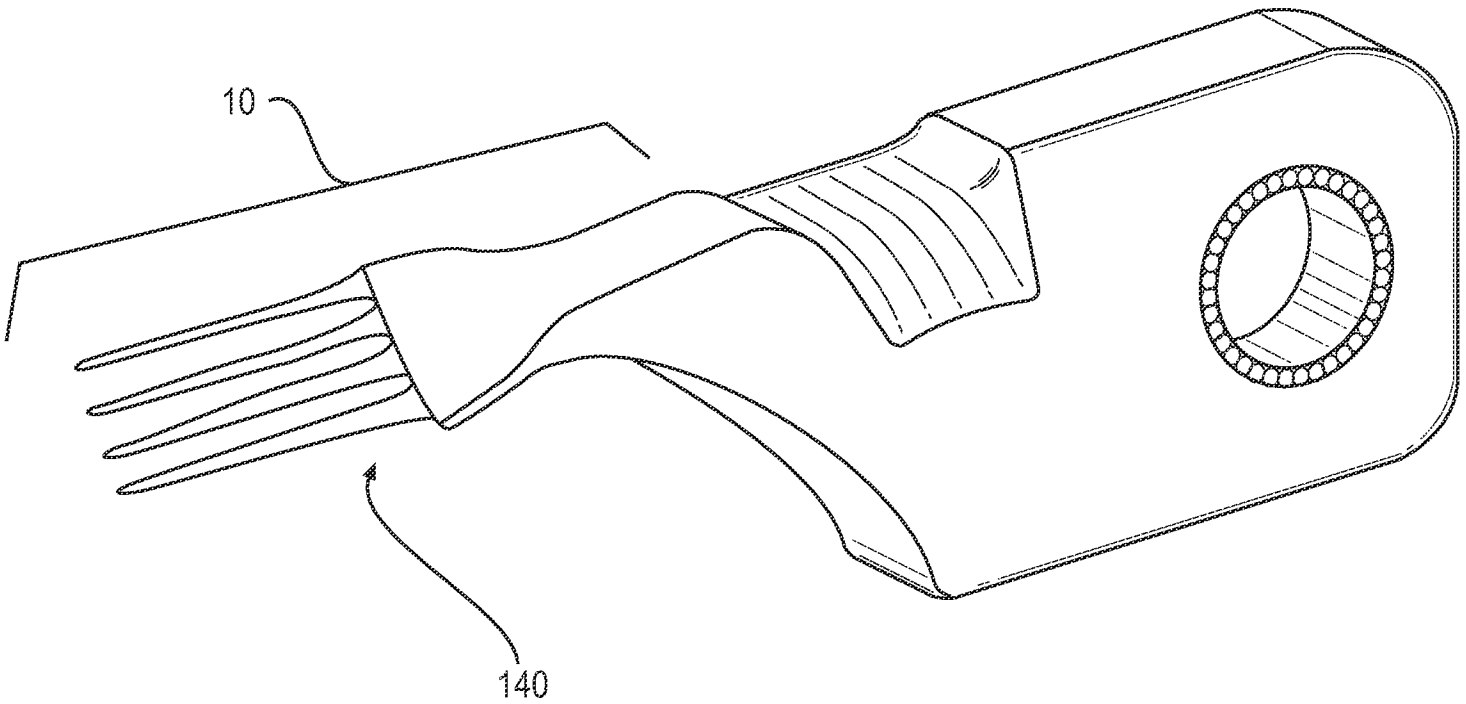
FIG. 12 is a perspective view of a hair lift tool embodiment of the present invention.

In use, one of the inner race 100 and the outer race 104 is rotationally fixed with respect to the handle section 12 while the other of the inner race 100 and the outer race 104 is free to rotate. As shown in FIG. 9, a user's digit 110 may be inserted into the rotational bearing 26 such that the inner race 100 is held substantially rotationally fixed with respect to the user's digit 110. Because of the nature of the rotational bearing 26, the hair implement 46 is capable of being rotated, as shown by the arrows, around the user's digit 110 with minimal force. The force is typically applied to finger support 24. Referring back to FIGS. 1 and 8A-8C, for ease of explanation, the remaining descriptions of the rotational bearing 26 will be written from the viewpoint of a configuration where the outer race 104 is rotationally fixed to the hair implement 46, but it will be understood by those of ordinary skill in the art that the rotational bearing 26 may be configured in such a way such that the outer race 104 may be rotationally fixed with respect to the user and the inner race 100 may be rotationally fixed with respect to the hair implement 46. Further details on the use are included below.

The rotational bearing 26 may have an outer race 104 that is fastened, adhered, pressed or otherwise connected to the handle section 12. In some embodiments, the outer race 104 of the rotational bearing 26 may itself be the handle section 12.

In some embodiments, the rotational bearing 26 may be designed such that the inner race 100 is capable of slightly tilting with respect to the bearing central axis 32 without affecting the orientation of the outer race 104 of the rotational bearing 26.

In some embodiments, a ring insert 30 may be removeably engaged to the rotational bearing 26. The ring insert 30 is typically secured within the outer race 104 and thus rotates with the outer race 104. An optional cover (not shown) can be used to further secure the ring insert 30 in place during use. The cover could be secured to handle portion 12 of hair implement 46 by screws or the like that can be easily removed to change the ring insert 30. The ring insert 30 is described in further detail below. The rotational bearing 26 may include a bearing securing feature capable of removably capturing, containing, enveloping, or connecting a ring insert 30. Referring to FIGS. 8A-8B, the bearing securing feature may be a bearing threaded portion 102. Referring to FIG. 8B, the rotational bearing 26 may be designed with one or more arresting pieces 108 to rotationally halt the inner race 100 or outer race 104 for aiding the removable engagement of the ring insert 30 with the rotational bearing 26. The bearing securing feature may be a threaded feature (e.g., as shown in FIGS. 8A and 8B) that is located on the inner race 100. Referring to FIGS. 3A-3C and FIG. 8C, the ring insert 30 may have corresponding one or more ring insert threaded features 58 (e.g., a threaded screw) capable of interacting with the bearing threaded portion 102. Referring to FIG. 8C, the bearing securing feature may include one or more bearing grooves 106 located on the inner race 100 which interact with bumps 50 on the ring insert 30.

Ring Insert

Referring to FIGS. 2A-3C, the ring insert 30 may be made out of one material or various materials combined together. The ring insert 30 may include a ring insert outer surface 52 and an inner surface 56 forming an aperture. The aperture may approximately take the form of a circle. The ring insert 30 may have an inner aperture between approximately a ring size of 5 (approximately 15.7 mm inner diameter) and approximately a ring size of 10 (approximately 19.76 mm inner diameter). In another implementation, the ring insert 30 may range in size from ring size 3 to ring size 12. It will be understood by those having ordinary skill in the art that the ring insert 30 may have an inner aperture having a diameter of less than a ring size of 5 (15.7 mm) or greater than a ring size of 10 (19.76 mm), i.e., the ring insert 30 may be sized to accommodate users having various hand and ring sizes. As shown in FIGS. 2A-2C and 3A-3C, the ring insert 30 may have a ring insert central axis 54. During use, the ring insert central axis 54 may be generally parallel to the bearing central axis 32. However, depending on the type of rotational bearing used, the ring insert central axis 54 may be capable of tilting away from parallel to the bearing central axis 32 while maintaining the same functionality.

Figure 2A:
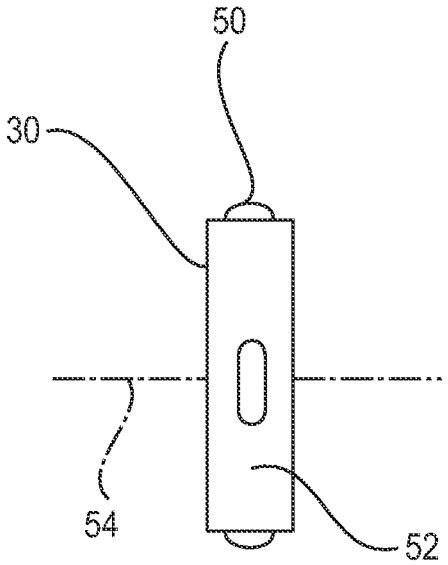
FIG. 2A is a side view of a ring insert as shown in FIG. 1.
Figure 2B:
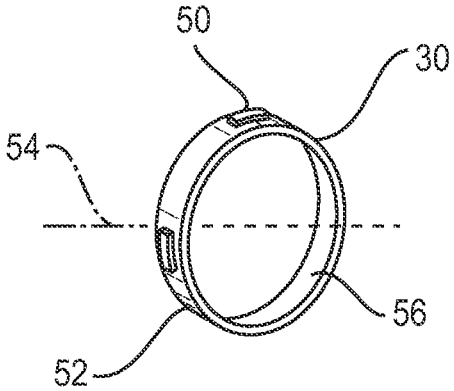
FIG. 2B is a perspective view of a ring insert as shown in FIG. 2A.
Figure 2C:
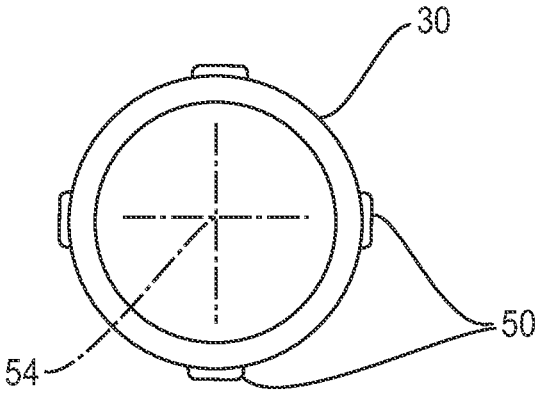
FIG. 2C is a front view of a ring insert as shown in FIG. 2A.
Figure 3A:
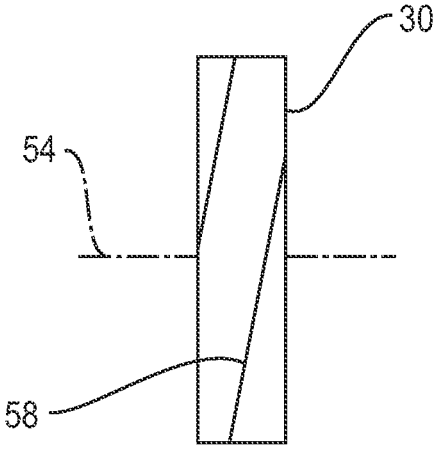
FIG. 3A is a side view of a ring insert as shown in FIG. 1.
Figure 3B:
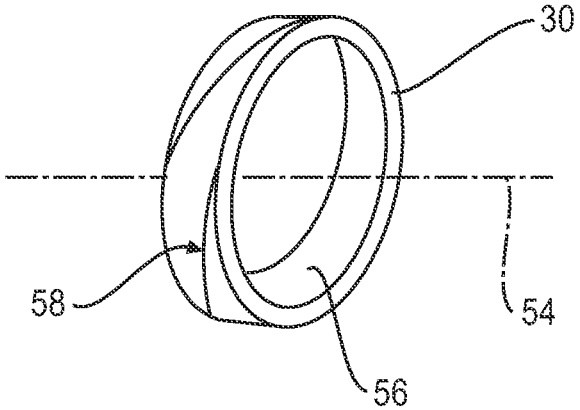
FIG. 3B is a perspective view of a ring insert as shown in FIG. 3A.
Figure 3C:
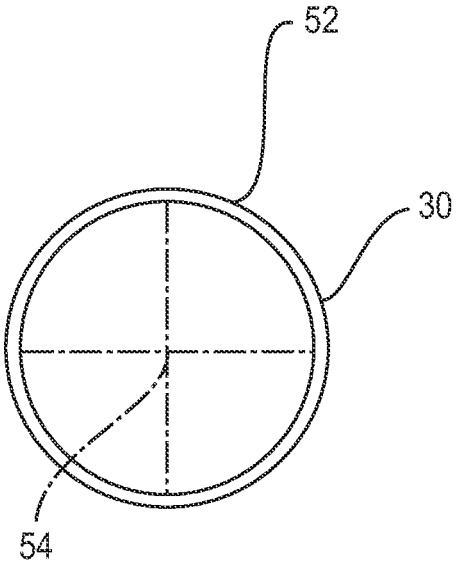
FIG. 3C is a front view of a ring insert as shown in FIG. 3A.

The ring insert outer surface 52 may have at least one ring securing feature designed to removably engage the bearing securing feature, such as the bearing threaded portion 102 or one or more bearing grooves 106. As shown in FIGS. 2A-2C, the ring securing feature may be one or more bumps 50. These bumps 50 are capable of removably clipping into one or more bearing grooves 106 located on the inner race 100 of the rotational bearing 26 as shown in FIG. 8C. The ring insert 52 is shown in FIGS. 2A-2C having a plurality of bumps 50, the ring insert 52 could also be implemented with a single bump 50 or lip that could snap into the bearing grooves as described above. In an embodiment shown in FIGS. 3A-3C, the ring securing feature may be one or more ring insert threaded features 58 (e.g., a threaded screw) capable of interlocking with the bearing securing feature threaded portion 22 of the rotational bearing 26 as shown in FIGS. 8A-8B. The ring securing feature may be of various different designs capable of removably engaging the inner race 100 of the rotational bearing 26, including, but not limited to, mechanical coupling and magnetic coupling.

In some embodiments, the ring insert 30 is not removeably coupled to the rotational bearing 26, but permanently or semi-permanently coupled to the rotational bearing 26. In such embodiments, the ring insert 30 may have a pre-determined aperture diameter. In some embodiments, the aperture may be adjustable. In some embodiments the adjustable aperture may use an iris mechanism to increase and decrease the aperture's diameter. A ring insert is provided with an initially small aperture or no aperture, and the ring insert may have perforations or knockouts allowing the aperture to be expanded as necessary. A further embodiment of the present invention has a ring insert with a flexible (pliable) material that may automatically adjust to various ring sizes.

The ring insert 30 may be made of any suitable material, including, but not limited to, metal or plastic.

Stem

Figure 4A:
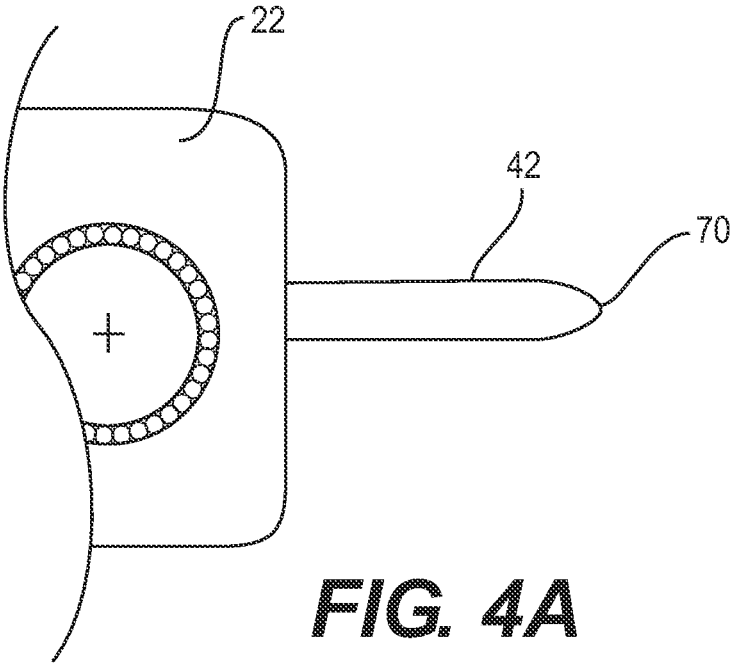
FIG. 4A is a portion of a front view of a stem as shown in FIG. 1.
Figure 4B:
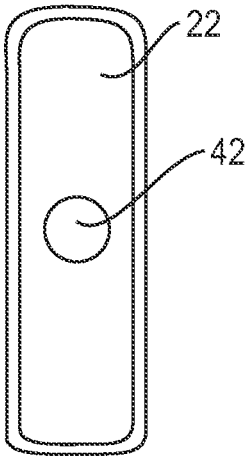
FIG. 4B is a side view of a stem as shown in FIG. 1.

Referring to FIGS. 1, 4A, and 4B, in some embodiments of the present invention, the handle section 12 may be proximate to or integrally formed with a stem 42 extending from a handle section proximal end 22 in a direction generally away from the spine section proximal end 18. Certain embodiments of the present invention may have the stem 42 extending approximately two inches away from the handle section 12 and terminating with a blunt tip 70, although stems of longer or shorter length are also contemplated (e.g., approximately 1 to 3 inches in length). The stem 42 may have a substantially circular cross-section having a diameter about 1/16 of an inch, although stems of smaller and larger diameters are also contemplated (e.g., approximately 1/32 to 1/4 inches). The stem 42 may be made of any suitable material, including, but not limited to, a metal or metal alloy such as stainless steel or suitable plastic material. The stem 42 may be made out of similar or different materials as the handle section 12 or spine section 10. The stem 42 may be fastened, adhered, injected, screwed, or otherwise connected to the handle section 12. The stem 42 may be used for techniques such as, but not limited to, parting, combing, brushing, aligning, or manipulating an object. For example, the stem may be used to create a precise part in the hair.

Finger Support

Referring to FIGS. 1, 6A, 6B, and 7, the hair implement may comprise a finger support 24 approximately located between the spine section distal end 16 and the handle section proximal end 22. As shown in FIG. 1, the finger support 24 is located between the spine section 10 and a rotational bearing 26. The finger support 24 may be operatively connected to at least one of the spine section 10 and the handle section 12. The finger support 24 may be made of the same piece of material as one or more of the handle section 12 and the spine section 10. The finger support 24 may be made of a separate piece of material attached to one or more of the handle section 12 and the spine section 10.

Figure 14:
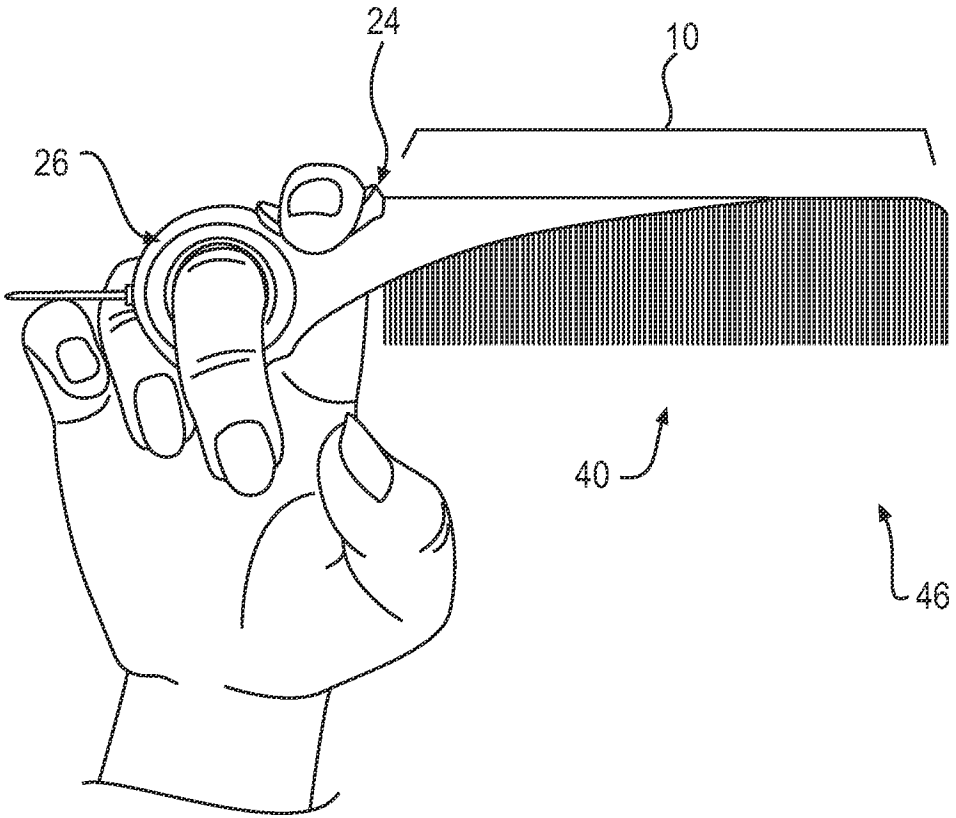
FIGS. 14-16 are representations of a particular use of the hair implement as shown in FIG. 1.

As shown in FIGS. 1 and 14, the rotational bearing 26 acts as a fulcrum about which the hair implement 46 may rotate if pressure is supplied to a finger support 24. If the finger support 24 is generally located between the spine section distal end 16 and the rotational bearing 26, the finger support 24 will be located opposite the plurality of teeth 40 such that a user is able to provide pressure on the finger support 24 (in a direction from the top of the page towards the bottom of the page when viewing FIGS. 1 and 14) to push the plurality of teeth 40 into or onto an object.

In an embodiment not shown, the finger support 24 may be generally located between the rotational bearing 26 and the stem 42, wherein the finger support 24 would be located on the same side of the hair implement 46 as the plurality of teeth 40, such that a user is able to provide pressure on the finger support 24 (in a direction from the bottom of the page toward the top of the page when viewing FIG. 1) to push the plurality of teeth 40 into or onto an object.

Figure 6B:
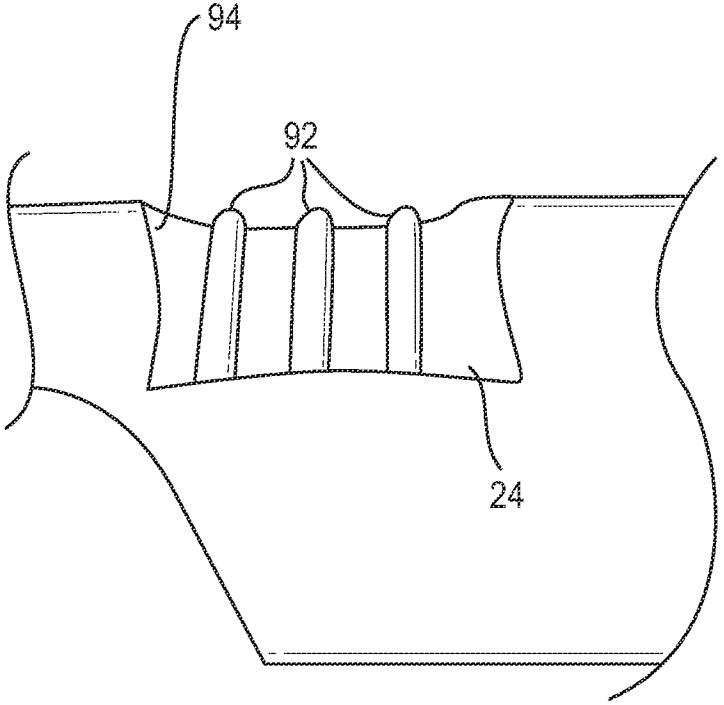
FIG. 6B is a front view of a finger support as shown in FIGS. 1 and 5.
Figure 6A:
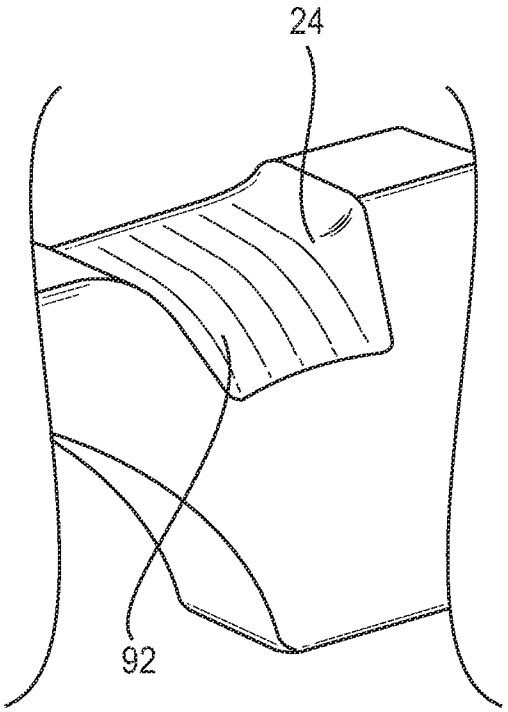
FIG. 6A is a perspective view of a finger support as shown in FIGS. 1 and 5.

Referring to FIGS. 6A and 6B, the finger support 24 may include a pliable cushion, including, but not limited to, a rubber cushion, gel cushion, or other similar malleable material, having a cross-section forming a concave arcuate path 94. The finger support 24 may also be configured to comprise at least one ridge 92 transverse to the concave arcuate path 94. The finger support 24 may be located between the handle section 12 and the spine section 10 and comprises a rubber cushion having a cross-section forming a concave arcuate path 94. Such features are meant to aid in the support of the user's finger or fingers on finger support 24 and for ease of handling of the hair implement by the user.

The parts of the finger support 24 may be made of any suitable material, including, but not limited to, rubber or plastic.

Method of Use

The hair implement 46 may be configured to allow a user to hold the handle section 12 and position the hair implement 46 about the rotational bearing 26 such that the plurality of teeth 40 extends toward a desired object such as, but not limited to, hair or scalp. A user can use a combing or brushing motion on or with the object using the plurality of teeth 40. Such combing may be accomplished by applying pressure to a finger support 24. A user may transition between functions of the hair implement 46 by rotating the hair implement about the bearing central axis 32 while maintaining contact with the handle section 12 such that the plurality of teeth 40 now extends away from the object. The user may hold the hair implement 46 by the inner race 100 of the rotational bearing 26 (e.g., by inserting a digit into the inner aperture of the ring insert).

Figure 15:
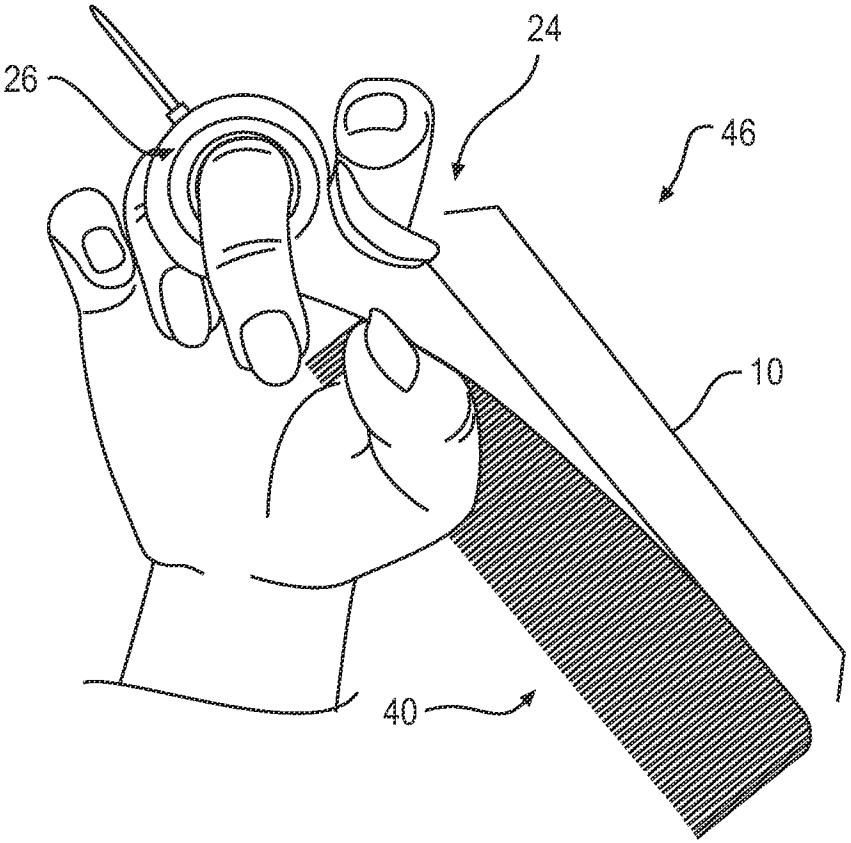
Figure 16:
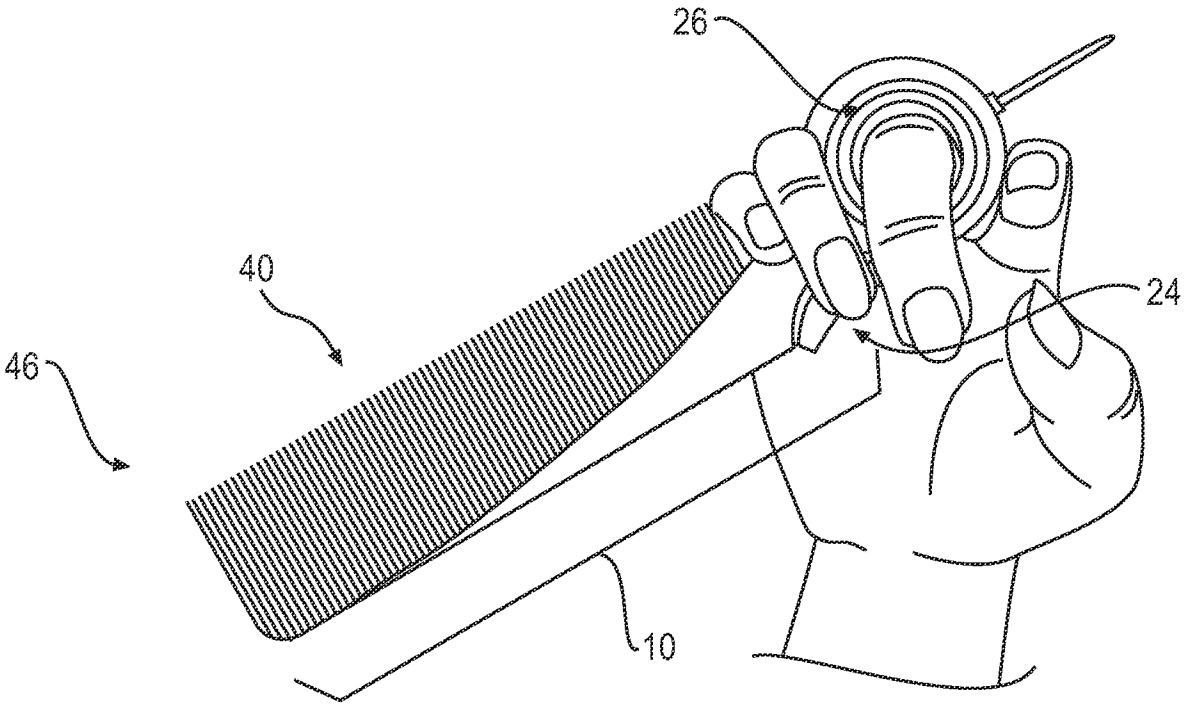

There may be many modes of operation and use of the hair implement of the present invention. One such use is shown in FIGS. 14-16, which show the hair implement 46 in three separate positions during use. FIG. 14 shows a first position, where the spine section 10 extends away from the user's hand and toward the object to be styled, such as hair. Pressure is maintained on the finger support 24 to facilitate styling the object with the plurality of teeth 40. By relaxing the grip and pushing further on the finger support 24 while away from the object to be styled, a user can transition the hair implement 46 into a second position, shown in FIG. 15, where the spine section 10 of the hair implement 46 may rest between the index finger and thumb of a user's hand or in the palm of the user's hand. In this second position, the user's fingers are free to hold and manipulate a second implement, such as brushes or hot curlers. The hair implement 46 can also be manipulated from the first to the second position by pressure from the index and middle fingers. If the thumb is moved out of the way, the second position could result in the hair implement 46 hanging straight down from the ring finger inserted into the ring insert. The user is then able to pick up another object while keeping the hair implement engaged with the hand in the second, down position. The hair implement 46 can be further manipulated into a third position by manipulating the spine section 10 such that it may be gripped by one or more of the ring finger, the middle finger, or the pinky finger. In this position, shown in FIG. 16, the stem 42 can be used to further style the object. It will be understood by one having ordinary skill in the art that the hair implement 46 may be transitioned from any of the three positions to another of the positions by simply manipulating the hair implement 46 in one or another direction about the rotational bearing 26. The hair implement 46 may be manipulated by a user's index finger while the user's middle finger rests in the rotational bearing 26. Nevertheless, the hair implement 46 can also manipulated in either a clockwise or counter-clockwise direction using any available fingers or external pressure from another source. It will be understood by one having ordinary skill in the art that the spine section 10 locations described above and depicted in FIGS. 14-16 are exemplary in nature and not intended to be limiting, as the preferred orientation of the hair implement 46 in a user's hand may vary depending upon the user's personal preferences and anatomical differences.

Figure 17:
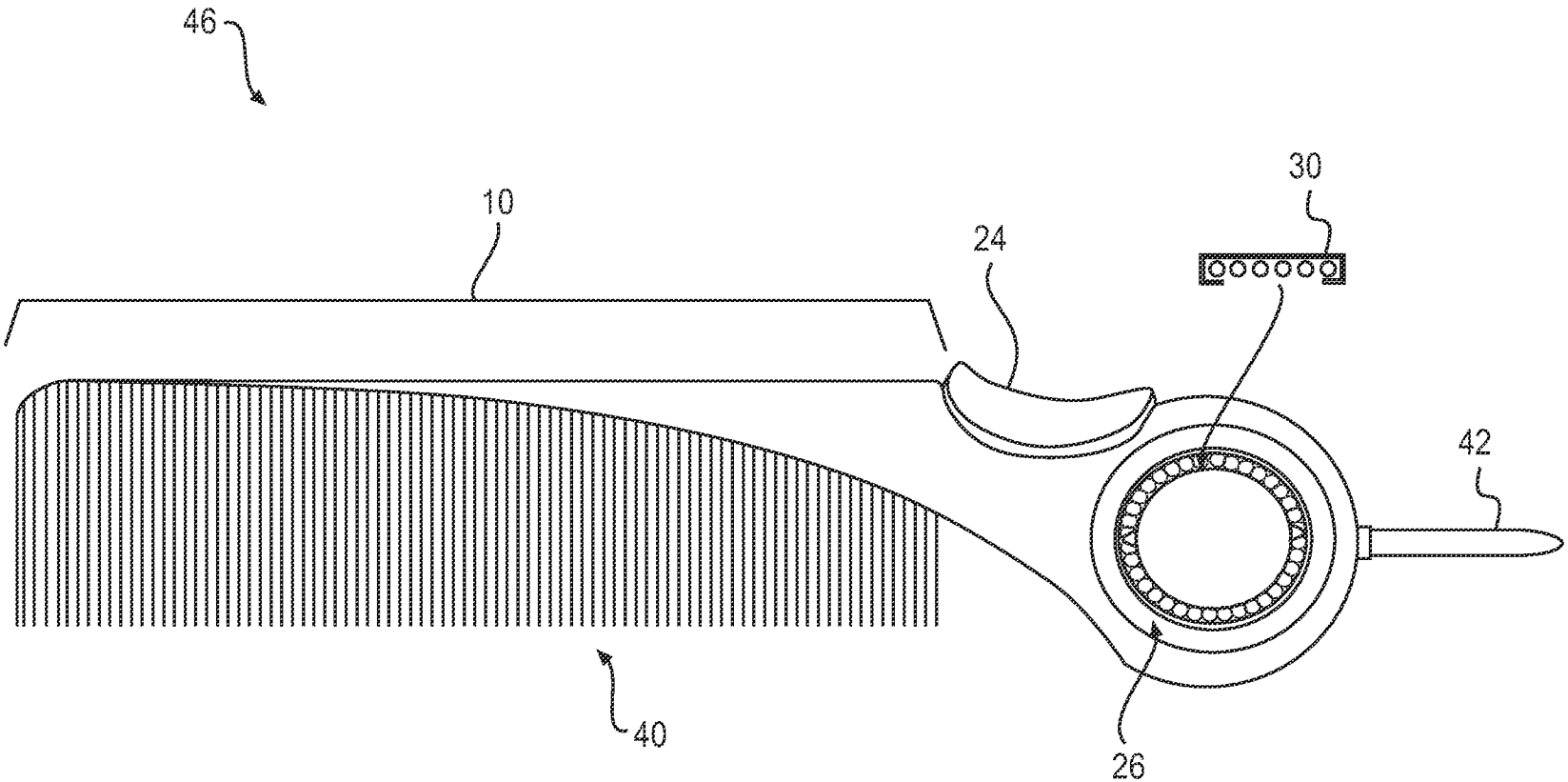
FIG. 17 is a representation of an exemplary embodiment hair implement of the present invention.

FIG. 17 shows another exemplary embodiment of the present invention with a sleek, curvier style. In this regard, it should be noted that the hair implement of the present invention may be implemented in various shapes and styles in keeping with the concept of the invention. FIG. 17 shows a cross-sectional view of ring insert 30 showing ball bearings within. Such ball bearings may be formed of plastic within a plastic frame, although metal may also be utilized. The ring insert 30 may be of various ring sizes for a particular user and may be removable to change between sizes for use by multiple users, or for use by the same user on different fingers or thumbs. It can simply be snapped into place. Finger rest 24 is implemented as a rubber cushion on the handle. Metal stem 42 can be used for parting hair or similar functions.

The headings used in this description are inserted for readability purposes only and are not to be construed as limiting, in any way, the contents of this disclosure.

Specific apparatuses and methods of using a hair implement have been disclosed. It should be apparent, however, to those skilled in the art that modifications other than those already described are possible without departing from the inventive concepts described herein. The inventive subject matter, therefore, is not to be restricted except in the spirit of the appended claims. Moreover, in interpreting both the specification and the claims, all terms should be interpreted in the broadest possible manner consistent with the context.

While embodiments of the present invention have been described in conjunction with specific exemplary implementations, it is evident to those skilled in the art that many alternatives, modifications, and variations will be apparent in light of the foregoing description. Alternate embodiments of the present invention may include implements other than the hair implement 46 described herein, including, but not limited to, cleaning brushes, tooth brushes, razors, and other user-manipulable implements for which the functionality described herein regarding the hair implement 46 is desired.

Figure 18:
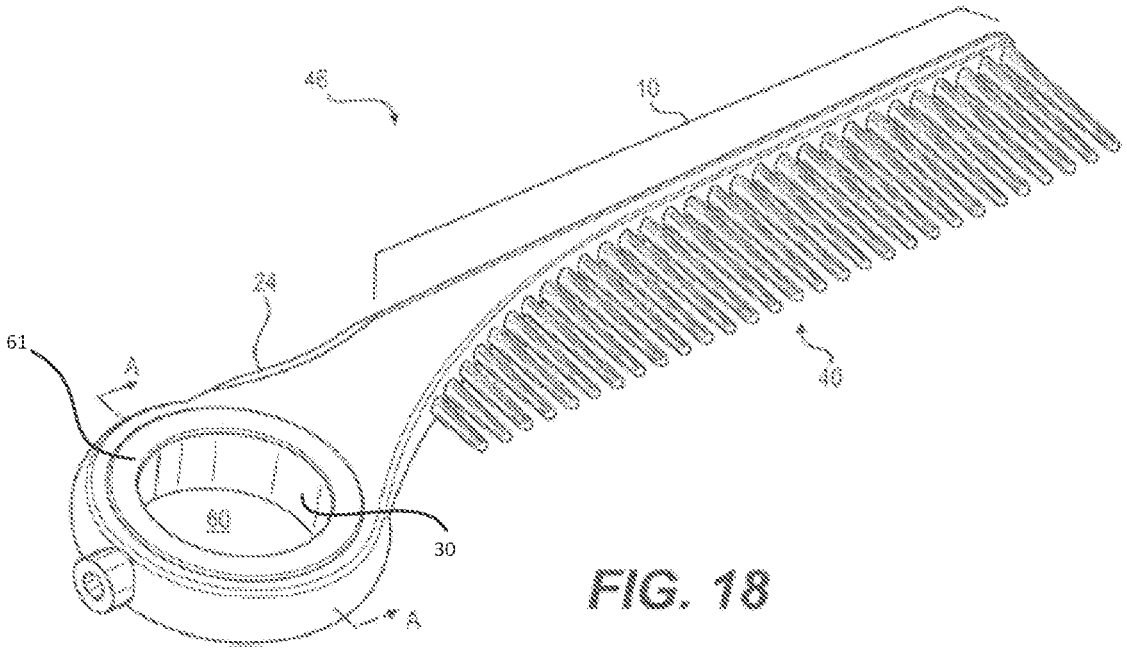
FIG. 18 is a perspective view of an implementation of the present invention as a rotatable comb.

Referring to FIG. 18, another implementation of hair implement 46 is shown. In this implementation, hair implement 46 is shown as a comb that can be manipulated about a user's finger. Any finger can be used to hold and manipulate the comb, as different users may prefer to use different fingers and some users may prefer to switch to another finger at a different time of use.

Hair implement 46 includes spine section 10 that includes a plurality of teeth 40 as in a standard comb. Hair implement 46 includes a standard comb handle having an annular opening or hole 60 into which a ring insert 30 is included. Ring insert 30 can be of various sizes depending on the finger size of the user and the particular finger used. In use, ring insert 30 rotates within annular opening 60 to permit the user to swing the comb out of the way when not in use, while retaining the hair implement 46 on the user's finger for immediate use when needed. Hair implement 46 is shown with optional finger support 24 on the handle, as described above.

Figure 19:
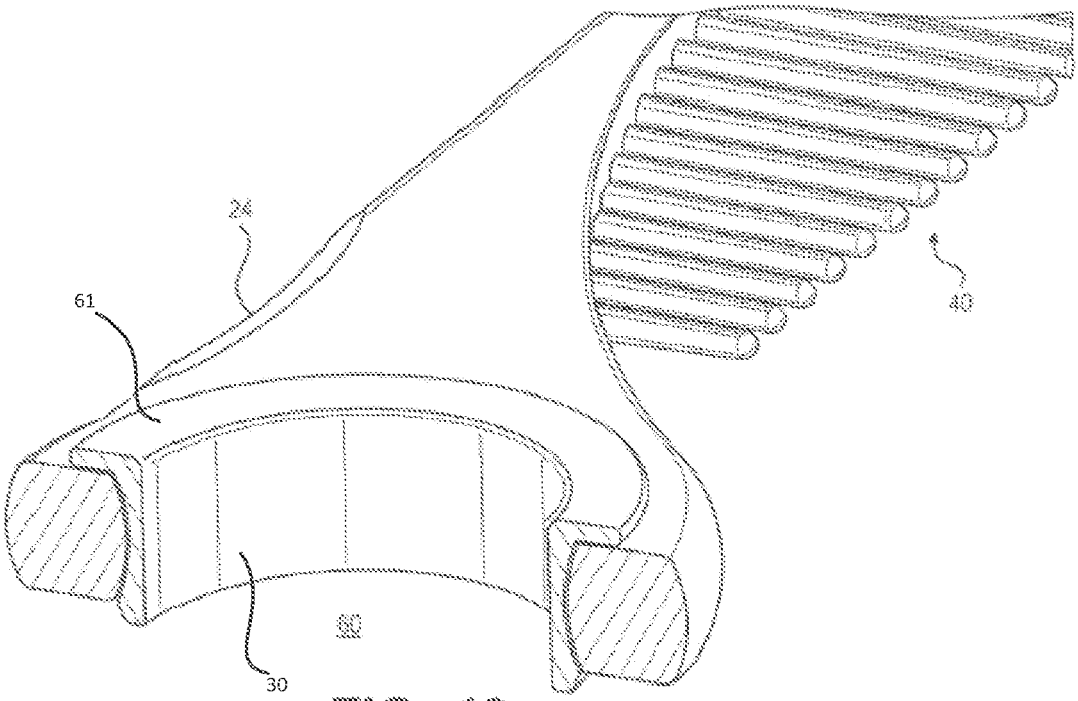
FIG. 19 is a cross-sectional view of the rotatable comb taken along line A-A of FIG. 18.
Figure 20:
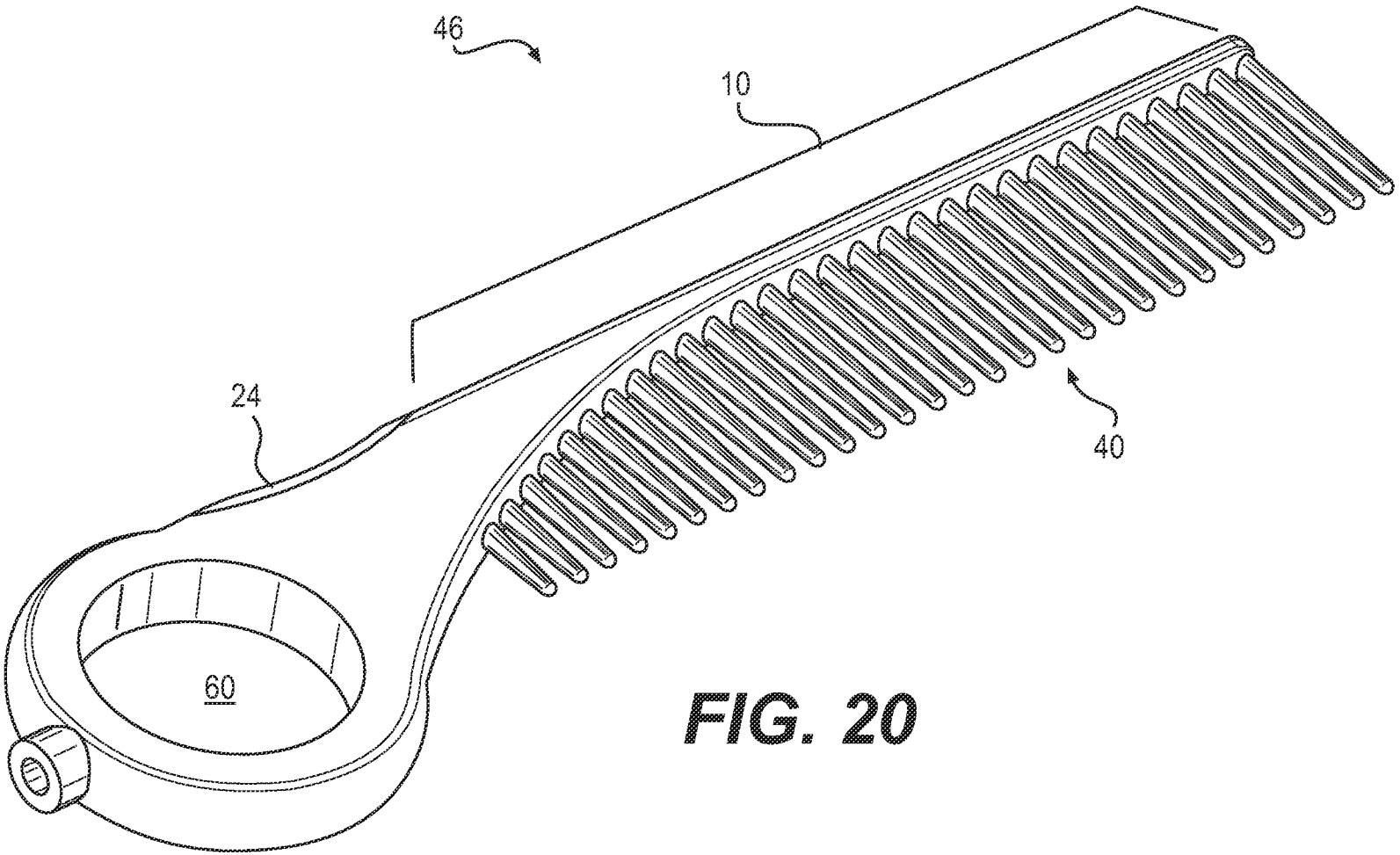
FIG. 20 is a perspective view of the rotatable comb as shown in FIG. 18, without the removable ring.

FIG. 19 is a cross-sectional view of hair implement 46 taken along line A-A of FIG. 18. As shown in FIG. 19, the ring insert 30 rotates within annular opening 60 directly against the annular opening 60 within the handle and without the need for bearings or other components. The ring insert 30 includes a lip or edge 61 that prevents the ring insert 30 from being pushed all the way through the handle. The ring insert 30 is pressed into the handle and is snapped into place to provide a snap fit or friction fit. A groove may be added to the surface of the annular opening 60 with a correspondingly raised portion of the ring insert 30 to further aid in providing the fit. When the user desires to change ring inserts 30, the ring insert 30 is pushed out of the handle from the side opposite the lip 61. The inside surface of annular opening 60 may have a slight convex curve, while the ring insert 30 includes a corresponding slight concavity on its exterior surface. FIG. 20 shows hair implement 46 without the ring insert 30.

Figure 21:
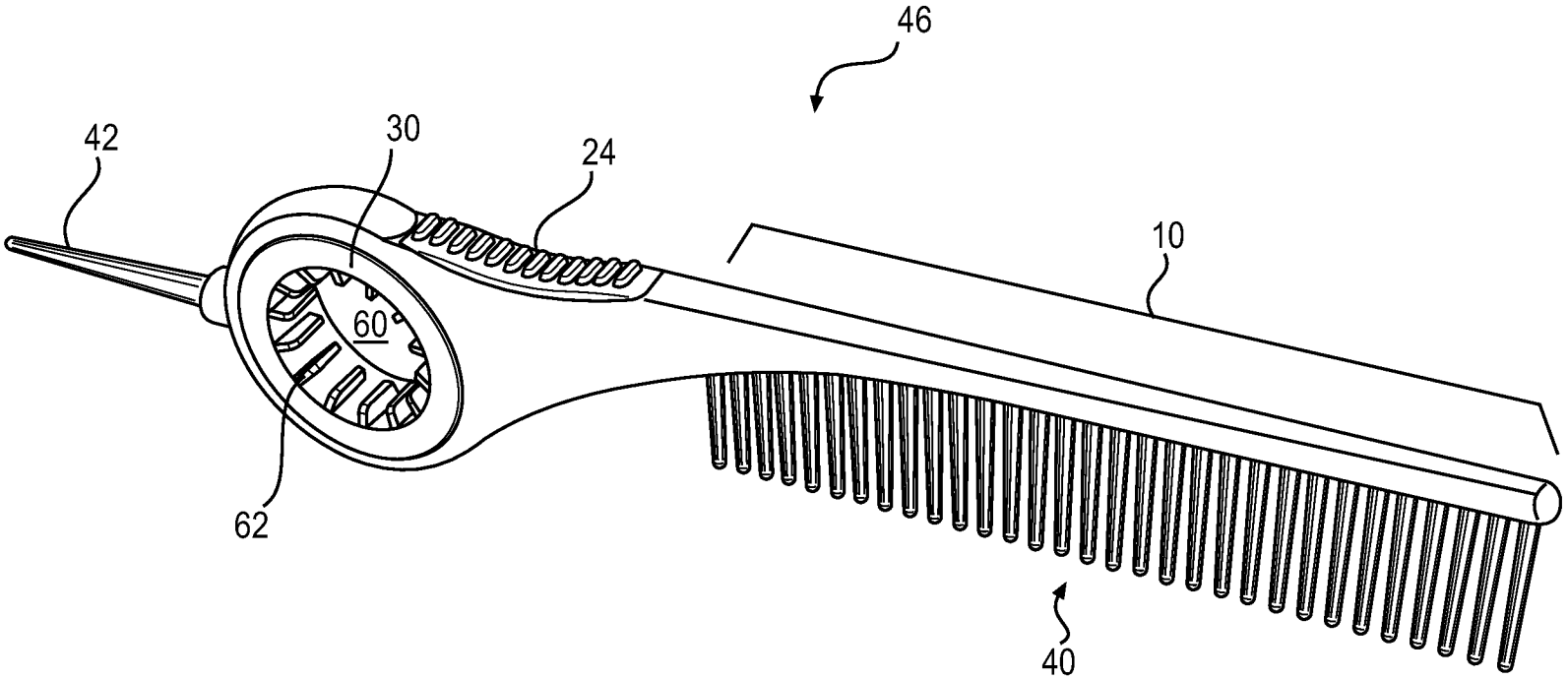
FIG. 21 is a perspective view of an implementation of the rotatable comb as shown in FIG. 18 having various features.
Figure 22:
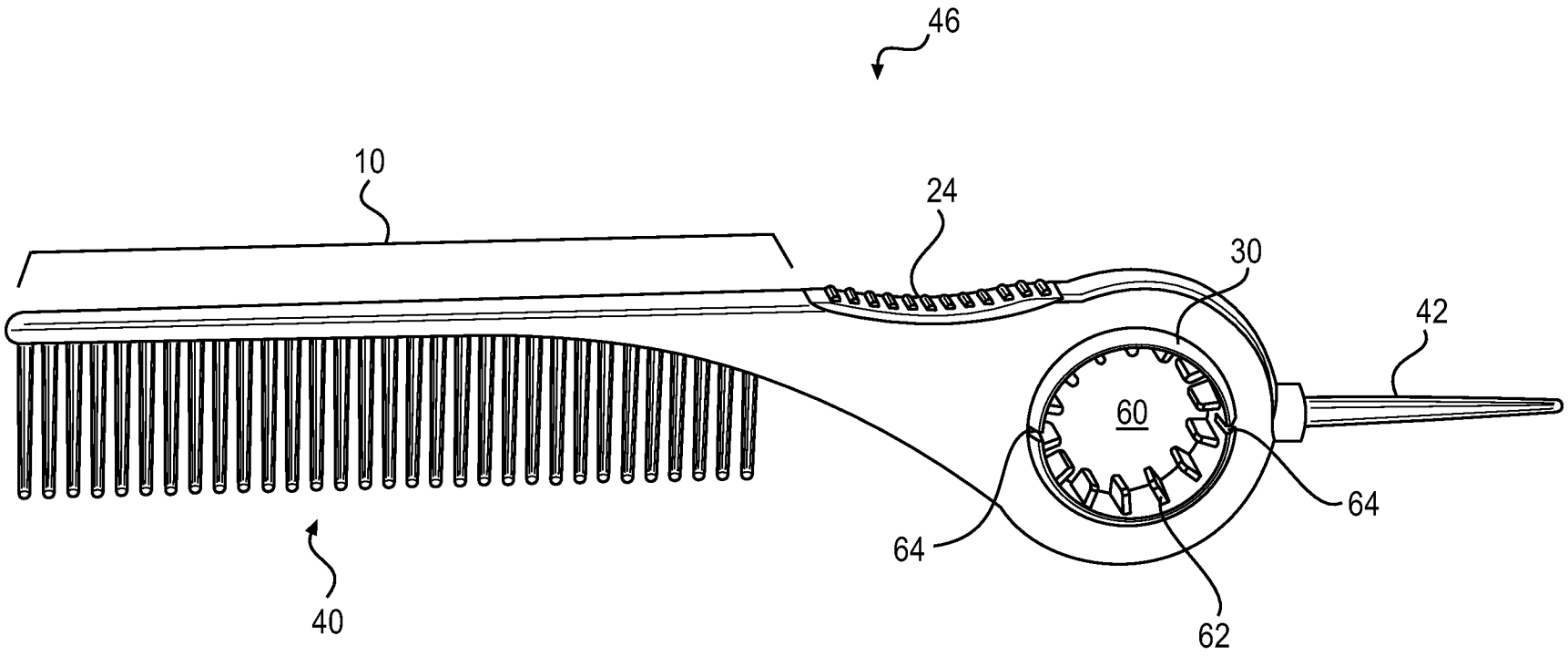
FIG. 22 is a side view of the rotatable comb as shown in FIG. 21.
Figure 23:
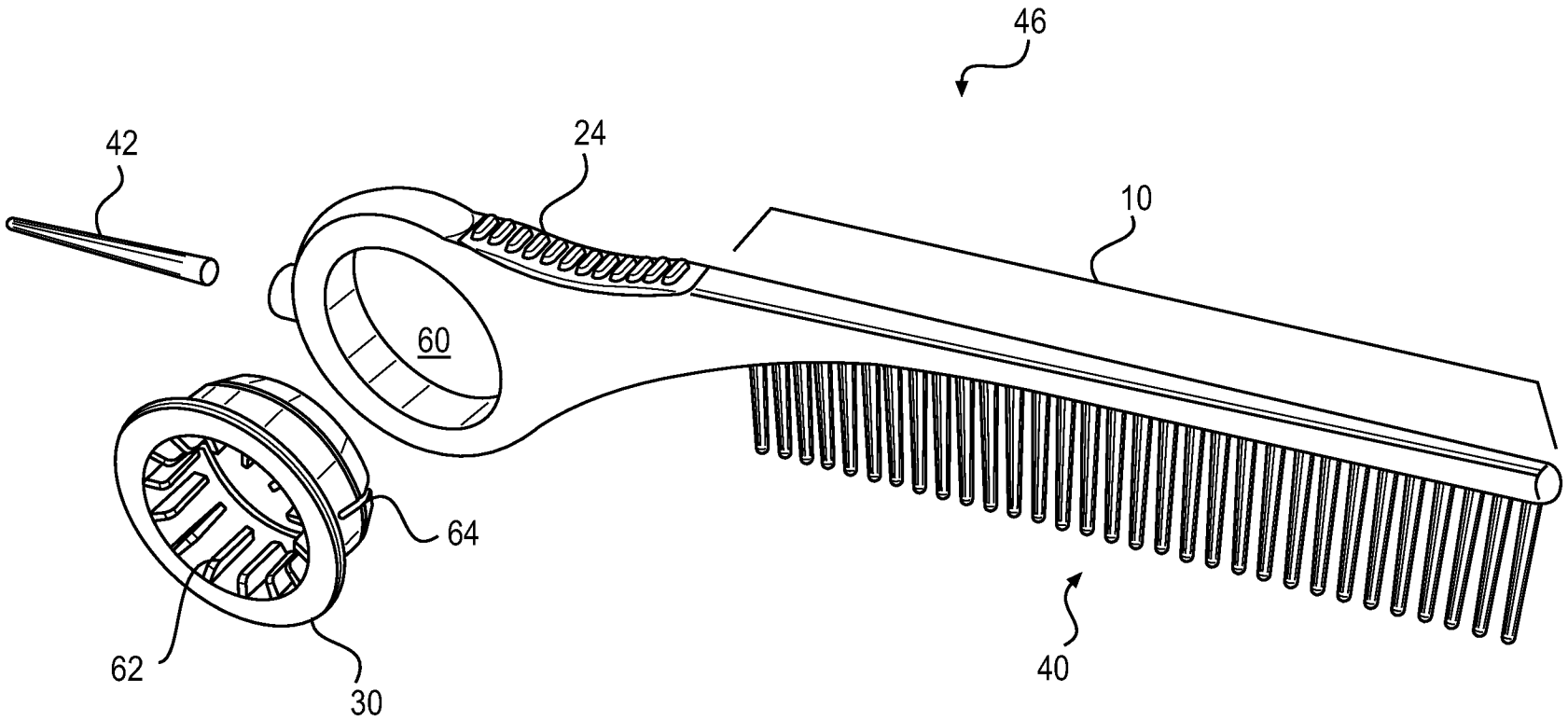
FIG. 23 is an exploded view of the rotatable comb as shown in FIG. 21.

FIGS. 21-23 show an implementation of the hair implement 46 as a comb that includes the rotatable ring insert 30 within annular opening 60, and also including stem 42 at the end of the handle opposite the spine section 10. The ring insert 30 is shown having fins 62 on its interior surface. These fins 62 aid in the ease of removal of the ring insert 30 from the user's finger, as the fins 62 are not as tight as when the inside surface of the ring insert 30 is smooth. The fins 62 also permit the ring insert 30 to remain relatively thin so that it can rotate smoothly within annular opening 60 and is easily inserted into the opening as well. In this implementation, the ring insert 30 is also shown with slits or cut-outs 64 at various places about its circumference. The ring insert 30 is shown having two slits 64 across from each other in the ring insert 30. A single slit 64 or additional slits 64 could also be used. The slits 64 permit the ring insert 30 to be compressed slightly to aid in insertion and removal from the annual opening 60.

Additionally, some embodiments of the present invention have been described with dimensions for the various elements. These dimensions are exemplary, and those of ordinary skill in the art would recognize that the dimensions may be modified according to the specific purpose or goal for which the particular element is being implemented. Accordingly, the embodiments of the present invention are intended to embrace all such alternatives, modifications, and variations that fall within the scope and spirit of the appended claims.

What is claimed is:

1. An article comprising:

a spine section that includes one of a comb, brush, pick, and a lifting tool;

a handle connected to the spine section, the handle having an annular opening through its width; and a removable ring insert that fits within the annular opening such that, in use, the handle rotates about a central axis of the removable ring insert, the removable ring insert further including:

at least two slits;

a plurality of fins; and, a lip that prevents the removable ring insert from being pushed all the way through the handle.

2. The article of claim 1, wherein the spine section and handle are integrally formed.

3. The article of claim 1, further comprising a finger support located on the handle.

4. The article of claim 1, wherein the the plurality of fins are located on an interior surface of the removable ring insert.

5. The article of claim 1, wherein the removable ring insert can be sized to include ring sizes 5 to 10.

6. The article of claim 1, wherein the removable ring insert provides a snap-fit within the annular opening.

7. The article of claim 1, wherein the slits facilitate removal of the removable ring insert from the annular opening.

8. A hair styling implement comprising:

a spine section that includes a comb, brush, pick, or lifting tool;

a handle connected to the spine section and configured to be held by a user's hand;

an annular opening within the handle; and a removable ring insert configured to fit within the annular opening such that the removable ring insert can rotate within the annular opening, the removable ring insert further including:

at least two slits configured to be compressed to facilitate the insertion and removal of the removable ring insert from the annular opening; and, a plurality of fins located on an interior surface of the removable ring insert configured to engage a finger of a user when the user inserts his or her finger into the annular opening.

9. A hair styling implement comprising:

a spine section that includes a comb, a brush, a pick, or a lifting tool;

a handle integrally formed with the spine section;

an annular opening within the handle;

a removable ring insert that can be fit within the annular opening such that the handle rotates about a finger of a user when the finger is inserted through the annular opening, the removable ring insert includes one or more fins located on an interior surface of the removable ring insert to engage the finger of the user, one or more slits to facilitate insertion and removal of the removable ring insert from the annular opening, and a lip that prevents the removable ring insert from being pushed all the way through the handle.

10. The hair styling implement of claim 9, wherein the removable ring insert has a snap fit or friction fit within the annular opening.

11. The hair styling implement of claim 9, wherein the annular opening has an inside surface with a convex shape and the removable ring insert has a corresponding concave shape on its exterior surface.

12. The hair styling implement of claim 9, further comprising one or more additional removable ring inserts having sizes that correspond to different ring sizes.

13. The hair styling implement of claim 1, wherein the handle is rotatably connected to the spine section.

14. The hair styling implement of claim 8, wherein the handle is rotatably connected to the spine section.

15. The hair styling implement of claim 9, wherein the handle is integrally formed with the spine section into a single, unibody structure.

* * * * *